US009896849B1

(12) United States Patent
Aboukhalil

(10) Patent No.: US 9,896,849 B1
(45) Date of Patent: Feb. 20, 2018

(54) FLUSH OR LAP SIDING SYSTEM

(71) Applicant: Charbel Tannious Aboukhalil, Redlands, CA (US)

(72) Inventor: Charbel Tannious Aboukhalil, Grand Terrace, CA (US)

( * ) Notice: Subject to any disclaimer, the term of this patent is extended or adjusted under 35 U.S.C. 154(b) by 0 days.

(21) Appl. No.: 15/296,970

(22) Filed: Oct. 18, 2016

(51) Int. Cl.
*E04F 13/08* (2006.01)
*E04B 1/41* (2006.01)

(52) U.S. Cl.
CPC ..... *E04F 13/0803* (2013.01); *E04B 1/40* (2013.01); *E04F 13/0864* (2013.01)

(58) Field of Classification Search
CPC ..... E04F 13/0803; E04F 13/0864; E04B 1/40
USPC ..... 52/520, 525, 551, 235, 478, 479, 483.1, 52/506.05, 506.06, 506.08, 506.09
See application file for complete search history.

(56) References Cited

U.S. PATENT DOCUMENTS 2,099,632 A * 11/1937 Starr ..... E04B 2/58 52/489.1
2,947,093 A 8/1960 Masters
4,184,301 A * 1/1980 Anderson ..... E04B 1/6104 52/309.9
4,680,911 A * 7/1987 Davis ..... E04F 13/0864 52/519
5,220,763 A 6/1993 Armitage
5,537,792 A * 7/1996 Moliere ..... E04D 1/265 52/521
5,598,667 A 2/1997 Dykes
5,661,937 A 9/1997 Doppler et al.
5,694,727 A 12/1997 Dobija
5,860,257 A * 1/1999 Gerhaher ..... E04F 13/0826 52/235
6,055,787 A * 5/2000 Gerhaher ..... E04F 13/0826 52/506.06
6,170,214 B1 1/2001 Treister et al.
6,205,731 B1 * 3/2001 Gerhaher ..... B28B 3/26 52/235
6,289,644 B1 * 9/2001 Gerhaher ..... E04F 13/0826 52/235
6,308,486 B1 10/2001 Medland
6,402,419 B1 * 6/2002 Watanabe ..... E04F 13/0846 248/220.22
6,510,635 B1 1/2003 Rudolph et al.
6,591,575 B2 7/2003 Benedettini
6,786,804 B2 * 9/2004 Watanabe ..... E04F 13/0864 451/54
7,478,507 B2 * 1/2009 Krause ..... E04F 13/0832 52/546

(Continued)

*Primary Examiner* — Brent W Herring
(74) *Attorney, Agent, or Firm* — Stetina Brunda Garred & Brucker

(57) ABSTRACT

A wall siding system that utilizes the same primary hardware (e.g. bottom rail and short clip) for mounting panels to a surface can be used to mount the panels in a lapped horizontal configuration, flush horizontal configuration or a flush vertical configuration. This greatly simplifies manufacturing of the hardware and yet allows for three different configurations. Additionally, the same finishing hardware (e.g. top cap, trim cleat and edge trim) may be used to hide one or more pieces of the primary hardware. The wall siding system may be mounted indoors or outdoors because the wall siding system allows for water trapped behind the panels to drain out and air out so that water is not trapped behind the panels.

13 Claims, 48 Drawing Sheets

(56) References Cited

U.S. PATENT DOCUMENTS 7,562,504 B2 7/2009 Herbst et al.
7,703,250 B2 * 4/2010 Girnghuber ..... B28B 3/269 52/235
7,726,083 B2 * 6/2010 Wagner ..... E04F 13/0812 52/235
8,347,577 B2 1/2013 Aboukhalil
8,567,140 B2 * 10/2013 Wagner ..... E04F 13/0805 52/235
8,839,582 B2 * 9/2014 Aboukhalil ..... E04F 19/022 52/460
8,844,235 B2 * 9/2014 Lukaszewicz ..... E04F 13/083 52/506.06
8,919,068 B2 * 12/2014 Wright ..... E04F 15/02183 52/302.1
8,979,052 B2 * 3/2015 Uota ..... E04F 13/0846 248/226.11
9,109,368 B2 * 8/2015 MacKenzie ..... E04F 13/0803
9,382,715 B2 * 7/2016 Cottier ..... E04F 13/0826
2003/0014936 A1 * 1/2003 Watanabe ..... E04F 13/0864 52/518
2006/0070329 A1 * 4/2006 Schiltz ..... B44C 5/0461 52/506.01
2008/0008433 A1 * 1/2008 Parker ..... E04F 13/0803 385/128
2009/0019795 A1 * 1/2009 Szacsvay ..... E04D 1/20 52/173.3
2009/0313935 A1 12/2009 Montgomery
2010/0132295 A1 * 6/2010 Bootier ..... E04F 13/0841 52/520
2010/0251647 A1 10/2010 Enns
2012/0302573 A1 11/2012 Jackson et al.
2012/0317909 A1 * 12/2012 MacKenzie ..... E04F 13/0803 52/288.1
2013/0091800 A1 4/2013 Aboukhalil

* cited by examiner

FLUSH OR LAP SIDING SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The various embodiments and aspects disclosed herein are directed to a wall siding system.

Wall siding systems have a plurality of panels that are either shown as being lapped over one another or flush with respect to adjacent panels. The panels may be oriented in a horizontal or vertical direction. However, there are certain deficiencies in existing wall siding systems.

Accordingly, there is a need in the art for an improved wall siding system.

BRIEF SUMMARY

A wall siding system is discussed herein that can be reconfigured to show a plurality of wall panels being lapped over one another in a horizontal orientation or the plurality of wall panels may have a flushed appearance with the wall panels being oriented in a horizontal or vertical direction. This is accomplished with the same primary hardware, namely, a bottom rail and a short clip. Moreover, the finishing hardware, specifically, the trim cleat, edge trim and the top cap can also be used to hide the edges of the panels and the short clip. By utilizing the same bottom rail and short clip in all of the different configurations, this allows the manufacturer to simplify manufacturing of the wall siding system because there is only one set of primary hardware and finishing hardware to install the panels in three different configurations.

More particularly, a wall having a flat surface and a wall siding system mounted on the flat surface for flush mounting or lap mounting a plurality of panels of the wall siding system is disclosed. The wall may comprise the plurality of panels, a bottom rail, a plurality of clips and a second panel. Each panel of the plurality of panels may be between 6' to 20' long, 3" to 24" high and have a thickness at least 5/16". The thickness of the panel 12, 112, 212 may be 5/16", 3/8" or 1/2". Each panel of the plurality of panels may have a lower lip and a rear tongue that defines a lower groove. Moreover, each panel may have an upper tongue.

The bottom rail may have a length at least 50% of a lowest most panel mounted to the flat surface. The bottom rail may be fastened to the flat surface level to a ground. Also, the lowest most panel may be engaged to the bottom rail with a tongue and groove connection.

The plurality of clips may be less than 12" long attached to the plurality of panels to mount the plurality of panels to the flat surface. Upper tongues of the panels may be received into lower grooves of a first row of the clips. The upper tongues may be closer to a front side of the panels for lap mounting the panels to the flat surface. Alternatively, if the upper tongues are closer to a rear side of the panels, such panels may be flush mounted to the flat surface.

The second panel may be mounted to the flat surface. A lower groove of the second panel may be received into an upper groove of the clip.

The bottom rail may have an upwardly directed tongue received into a groove formed on a lower edge of the lowest most panel. The lower lip may extend downward so that a lower edge of the lower lip is at or below a lower end of the bottom rail.

Each clip of the plurality of clips may have upper and lower grooves vertically aligned to each other. The upper tongues of the panels may be received into the lower groove. The plurality of clips can be used with a first set of the plurality of panels configured for lap mounting, or alternatively, the plurality of clips can be used with a second set of the plurality of panels configured for the flush mounting of the second set of panels.

The upper tongues of the panels may be closer to a front side of the panels so that the panels appear lapped over one another, or alternatively, if the upper tongues are closer to a rear side of the panels, then the panels appears flush to one another.

The system may further comprise edge trims and trim cleats for hiding edges of the panels. The system may further comprise a top cap attachable to the clips for hiding the clips.

The upper and lower grooves of the clip may be defined by upper and lower rear walls and upper and lower front walls. The rear walls may be skewed with respect to front walls. More particularly, the upper rear wall of the clip may be skewed about 4 degrees from the upper front wall of the clip. Also, the lower rear wall of the clip may be skewed about 4 degrees from the lower front wall of the clip.

The plurality of drainage holes may be formed in an extension plate so that water disposed between the surface and the panels drain out to mitigate mold formation.

The panels may be horizontally oriented on the bottom rail and the clips.

Alternatively, the panels may be vertically oriented on the bottom rails and the clips.

The clips may be spaced apart from each other to facilitate movement of air between the surface and the panels.

In another aspect, a method of installing a wall siding system is disclosed. The method may comprise the steps of attaching a bottom rail to a flat surface, the bottom rail being level to a ground; engaging a bottom edge of a first panel to the bottom rail with a tongue and groove connection; attaching a first row of clips to the flat surface, the clips of the first row being spaced apart from each other to permit air to flow between the spaced apart clips of the first row and the flat surface and the first panel; engaging an upper tongue of the first panel to a lower groove of the clips of the first row, the upper tongue of the first panel being disposed closer to a back side of the first panel for flush mounting the first panel with respect to a second panel or the upper tongue of the first panel being disposed closer to a front side of the first panel for lap mounting of the first panel with respect to the second panel; engaging a bottom edge of the second panel to the clips of the first row with a tongue and groove connection; engaging a second row of clips to the flat surface, the clips of the second row being spaced apart from each other to permit air to flow between the spaced apart clips of the second row and the flat surface and the second panel; engaging an upper tongue of the second panel to a lower groove of the clips of the second row, the upper tongue of the second panel being disposed closer to a back side of the second panel for flush mounting the second panel with respect to a third panel or the upper tongue of the second panel being disposed closer to a front side of the second panel for lap mounting of the second panel with respect to the third panel.

The method may further comprise the step of providing the clips with upper and lower grooves. The upper and lower grooves may be defined by upper and lower front and rear walls. The rear walls may be skewed from the front walls so that the panels can tilt for lap mounting of the panels or be vertical for flush mounting of the panels. The providing step may further comprise the step of providing the skew angle between the front and rear walls of about 4 degrees.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
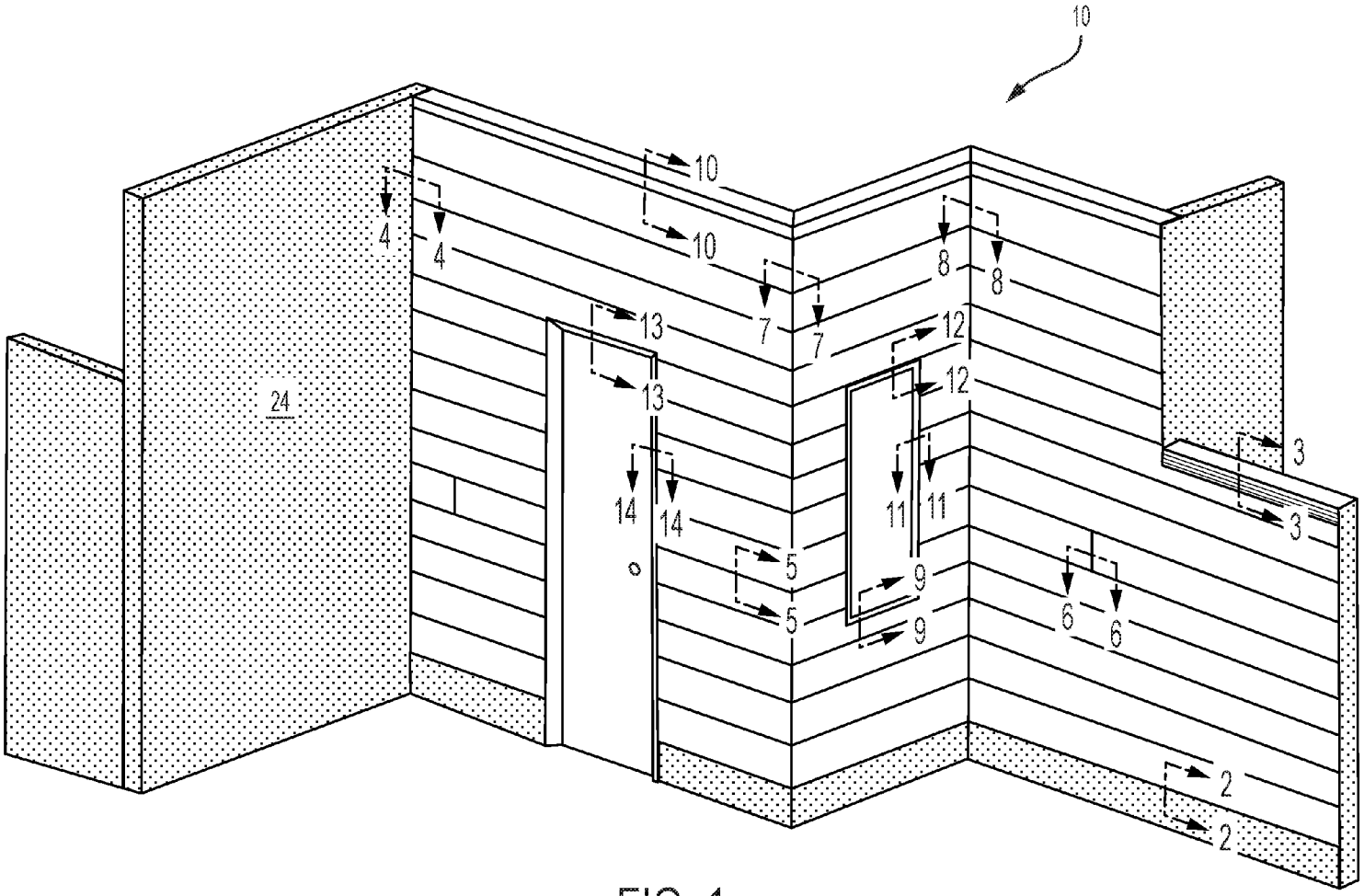
FIG. 1 illustrates a perspective view of a wall siding system with horizontally oriented panels shown as being lapped over one another.
Figure 15:
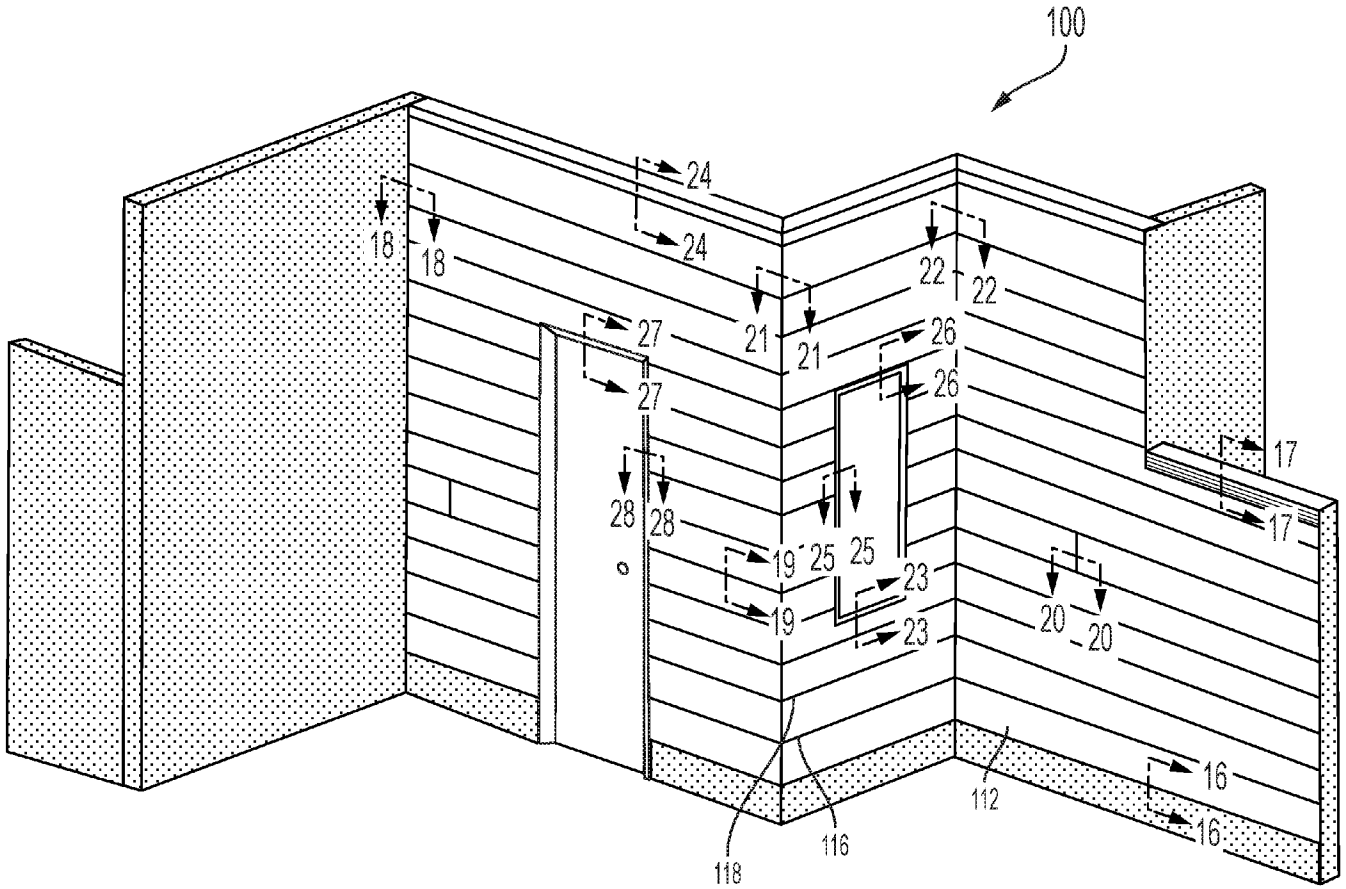
FIG. 15 illustrates a perspective view of a wall siding system with horizontally oriented panels shown as being flush with one another.
Figure 29:
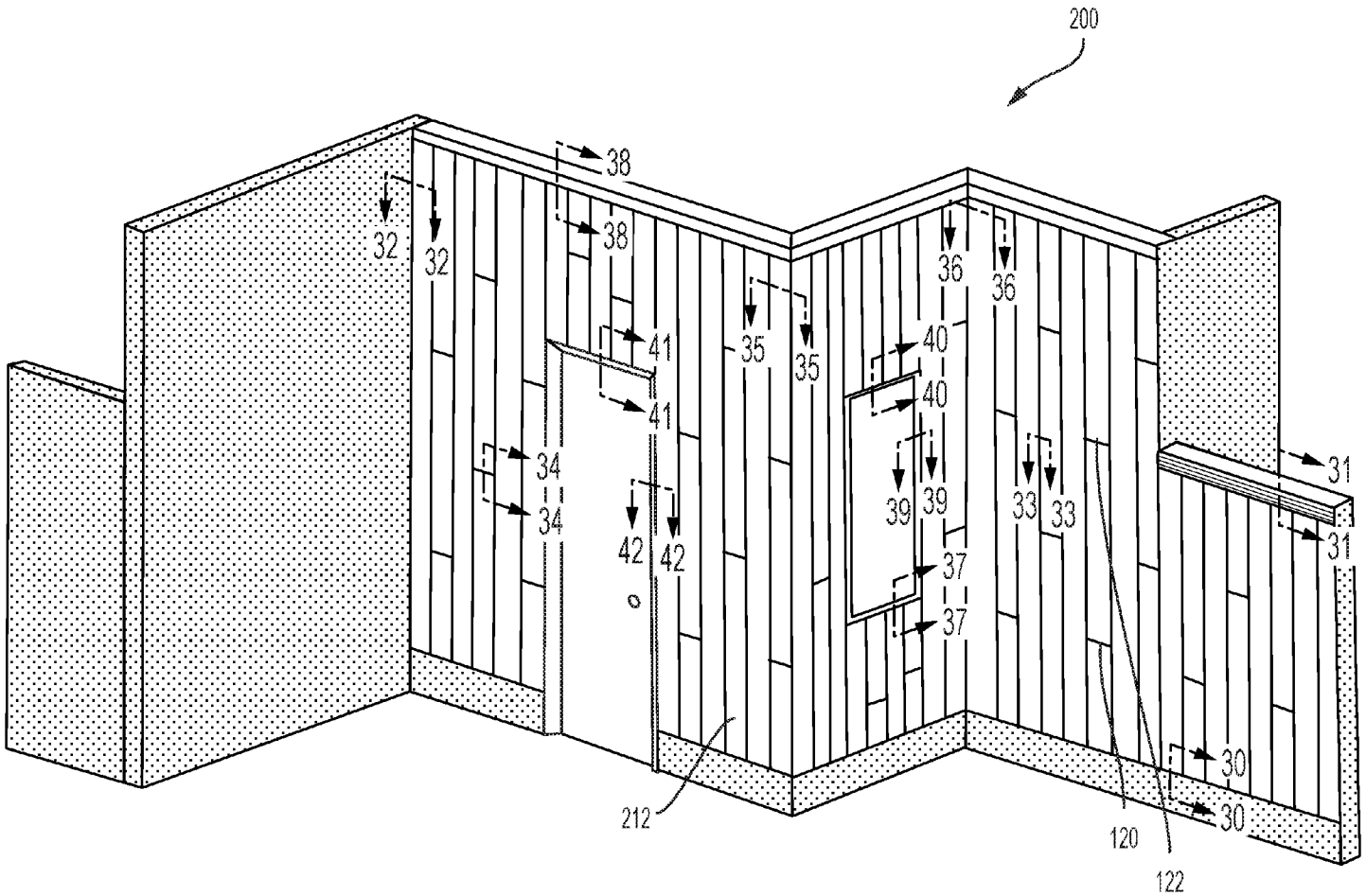
FIG. 29 illustrates a perspective view of a wall siding system with vertically oriented panels shown as being flush with one another.

Referring now to the drawings, an exterior wall siding system 10, 100, 200 is shown in FIGS. 1, 15 and 29. The wall siding system 10 shown in FIG. 1 illustrates a lap wall siding system 10. The wall siding system 100 shown in FIG.

15 illustrates a flush wall siding system 100 with elongate panels 112 in a horizontal orientation. The wall siding system 200 shown in FIG. 29 illustrates a flush wall siding system 200 with elongate panels 212 in a vertical orientation. Regardless of the orientation or whether the panels appear flush or lapped over one another, the same hardware including an elongate bottom rail 14 (see FIG. 2) and a short clip 16 (see FIG. 3) may be utilized to mount panels 12 to the surface 24. Other hardware may be utilized including but not limited to a top cap 18, an edge trim 20 and a trim cleat 22 (see FIGS. 3 and 4). The only part regardless of orientation (i.e., horizontal or vertical) or style (i.e., flush or lap) that is modified is the panels 12, 112, 212. The panel 12 (see FIG. 5) which is shown as adjacent panels 12 lapped one over the other is different than the panels 112 (see FIG. 19) which are shown as flush to each other. Also, the panel 112 (see FIG. 19) which is shown as being flush to other panels 112 in a horizontal direction is different than the panel 212 (see FIG. 33) which is shown as being flush to each other but in a vertical direction.

More particularly, referring now to FIG. 1, the lap wall siding system 10 is shown. The lap wall siding system 10 has a plurality of panels 12 that are mounted to a surface 24. The surface 24 may be, including but not limited to a wall of a building, or even a surface of a piece of furniture. Additionally, although the lap wall siding system 10 is shown and described in relation to a vertical surface 24, the lap wall siding system 10 may also be installed on a non-vertical surface including but not limited to a horizontal surface (e.g. ceiling, roof). Additionally, the lap wall siding system 10 may be installed to an interior or exterior surface exposed to rainwater and sun.

The panels 12 may be mounted to the vertical surface 24 from the bottom up direction. In this regard, the first panel 12 to be installed is the lowest most panel 12. In order to install the lowest most panel 12 to the vertical surface 24, the bottom rail 14 is attached to the vertical surface 24. By way of example and not limitation, the bottom rail 14 may be attached to the vertical surface 24 with a plurality of wall fasteners 26. The fastener 26 may be a wood screw, drywall screw, stucco screw, adhesive and other means of attaching the bottom rail 14 to the vertical surface 24.

The bottom rail 14 may have a length at least about 50% of a length of the panel 12 that the bottom rail 14 supports. For example, the panel 12 may be about 4 feet to 12 feet long. In this case, the bottom rail 14 may be about 2 feet to 6 feet long. Preferably, the bottom rail 14 extends along 90% to 100% of the length of the panel 12. For example, if the panel 12 is 12 feet long, then the bottom rail 14 extends preferably the full length of the panel 12, namely, 12 feet. The bottom rail 14 may support to all of the panels 12 above it when the lap wall siding system 10 is mounted to the vertical surface 24. However, it is also contemplated that the bottom rail 14 may support only the lowest most panel 12 and each intervening set of clips 16 may support the immediately adjacent panel that is resting on that set of clips. Although the bottom rail 14 is described as being at least 50% of the length of the panel 12 that the bottom rail 14 supports, it is also contemplated that the bottom rail 14 may be a plurality of short length (e.g. 1 inch to 1 feet) rails 14 mounted along the length of the lowest most panel 12. The number of short length rails 14 should be sufficient to support the weight of the panels 12.

The bottom rail 14 may be fabricated from aluminum or some other metallic or non-bending material given the weight of the system 10. The aluminum may be extruded into the shape shown in FIGS. 2 and 2A. After extruding the aluminum into the shape of the bottom rail 14 shown in FIGS. 2 and 2A, the plurality of holes 28 may be drilled along the length of the back plate 30. A sufficient number of holes 28 may be formed in the back plate 30 in order to secure the bottom rail 14 to the vertical surface 24 and support the weight of the system 10 as needed. The bottom rail 14 may also be extruded with an offset plate 32 which spaces the panel 12 away from the vertical surface 24. A length 34 of the offset plate 32 may be sufficiently long so that an interior surface 36 of the panel 12 is spaced away from the vertical surface 24 at least ½" and more preferably at least ¾". The bottom rail 14 and more particularly, an upwardly extending tongue 40 may receive a bottom edge portion of the panel 12. The panel 12 may appear to be lapped over one another. As such, the top edge portion of the panel 12 is closer to the vertical surface 24 compared to the bottom edge portion of the panel 12. The offset plate 32 is sufficiently long 34 so that the top edge portion of the panel 12 is at least ½" to at least ¾" away from the vertical surface 24.

The offset plate 32 may be perpendicular with respect to the back plate 30. When the back plate 30 is mounted to the vertical surface 24, the offset plate 32 may be generally horizontal to the ground surface. The offset plate 32 may additionally have a plurality of drainage slots 38 so that rainwater, that flows behind the panels 12 flow between the panels 12 and vertical surface 24, can drip down and escape through the drainage slots 38 so that water is not retained behind the panels 12. As shown in FIG. 2A, a top surface 128 of the offset plate 32 may have a funnel-shaped cross-sectional configuration wherein a first row of the drainage slots 38 may be formed at the lowest portion of the top surface 128 so that water is urged into and through the drainage slots 38 to prevent accumulation of water. There may also be a second row of drainage slots 38 parallel to the first row of drainage slots 38. The drainage slots 38 of the first and second rows may be offset from each other. Surface 128 may have about a 1 degree slope 41 toward slot 38. Surface 37 may have about a 9 degree slope 43 toward the slot 38. Water is not allowed to accumulate behind the panels 12 to mitigate formation of mold. The drainage slots may be about ¾ of an inch long by about 3/16 of an inch wide and a sufficient number of drainage slots 38 may be formed in the offset plate 32 in order to drain all the water that might be trapped behind the panel 12. Water may be introduced behind the panel if the panel was mounted to an exterior surface 24 from rainwater. Moreover, the drainage slots 38 provide air passage so that air can flow behind the panels 12 to dry up any water that might still be behind the panels 12.

Figure 16:
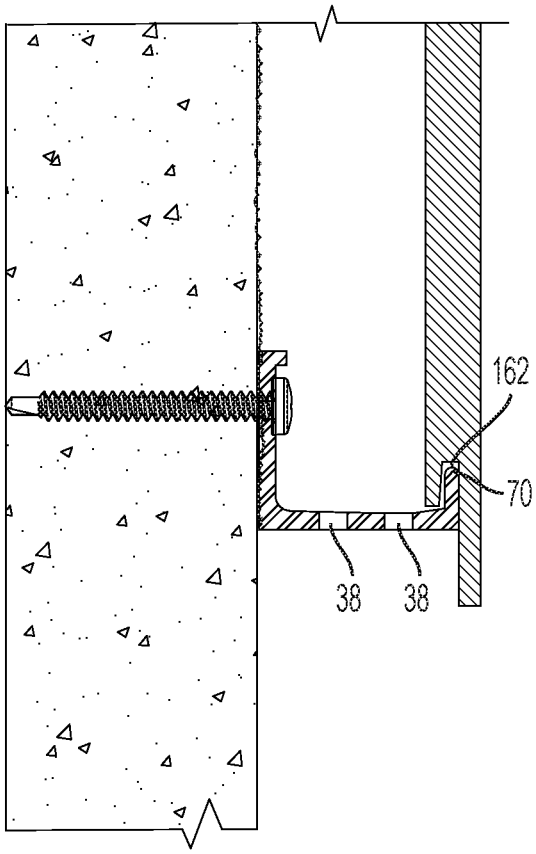
FIG. 16 illustrates a cross-section of the wall siding system shown in FIG. 15.
Figure 30:
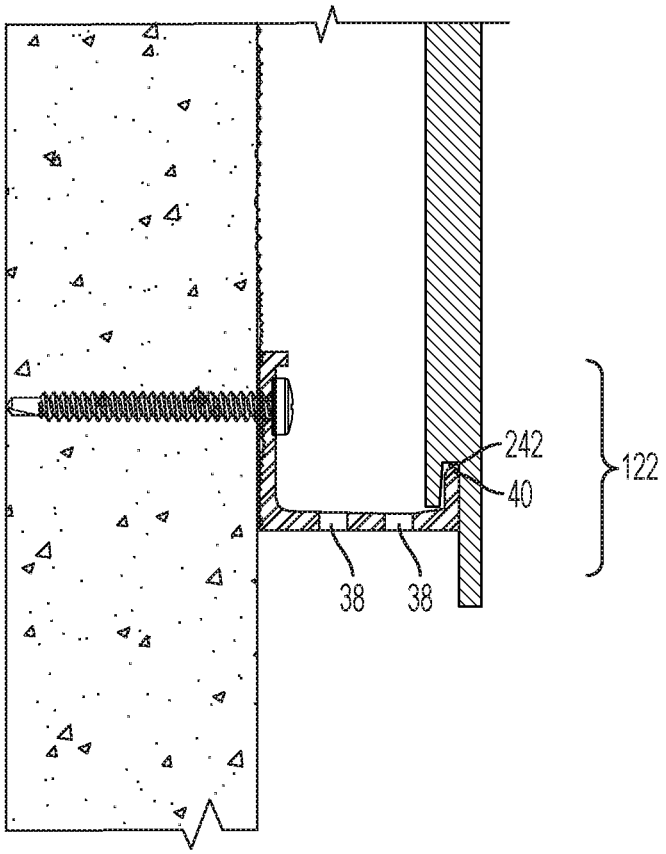
FIG. 30 illustrates a cross-section of the wall siding system shown in FIG. 29.

The upward extending tongue 40 may be formed at a distal end of the offset plate 32. The tongue 40 protrudes upward and may have a rounded distal end. The tongue 40 is preferably about 0.078 inches thick 130 and 0.230 inches long 132. The rounded distal end allows the panel 12 to be received on the tongue 40 in a cocked position and not oriented in a perfect vertical orientation so that the panels 12 can be lapped one on top of the other. The rounded distal end may have a radius of 0.039 inches. Additionally, the panels 112, 212 can be oriented in a generally vertical orientation so that the upper and lower panels can be flushed with one another, as shown and discussed in relation to FIGS. 16 and 30.

The panel 12 may be horizontally oriented as shown in FIG. 1. The panel 12 may also have a groove 42 formed in a lower end portion 44 of the panel 12. The groove 42 may have a width 46 of about 0.080 inches wide 46. The groove 42 may be defined by a rear wall 48 and a front wall 50. The rear wall 48 may have a thickness 52 of at least about 0.080 inches. The front wall 50 may have a thickness 54 of at least about 0.1525 inches. Depending on a thickness 56 of the panel 12, the thickness 54 of the front wall 50 may vary accordingly.

The bottom rail 14 may be attached to the vertical surface 24 so that the bottom rail 14 is level to the ground. A level may be used to orient the bottom rail 14 in the horizontal orientation. The lowest most panel 12 is secured to the bottom rail by inserting the upwardly extending tongue 40 into the groove 42 of the lower end portion 44 of the panel 12. The lowest most panel 12 rests and is supported on the bottom rail 14. As such, a sufficient number of wall fasteners 26 must be used to secure the bottom rail 14 to the vertical surface 24. Additionally, the bottom rail 14 should be fabricated from a material and be sufficiently thick to prevent any significant bending or deformation of the bottom rail 14 based on the weight of the system 10 and other factors that might impose forces on the bottom rail 14.

Figure 3:
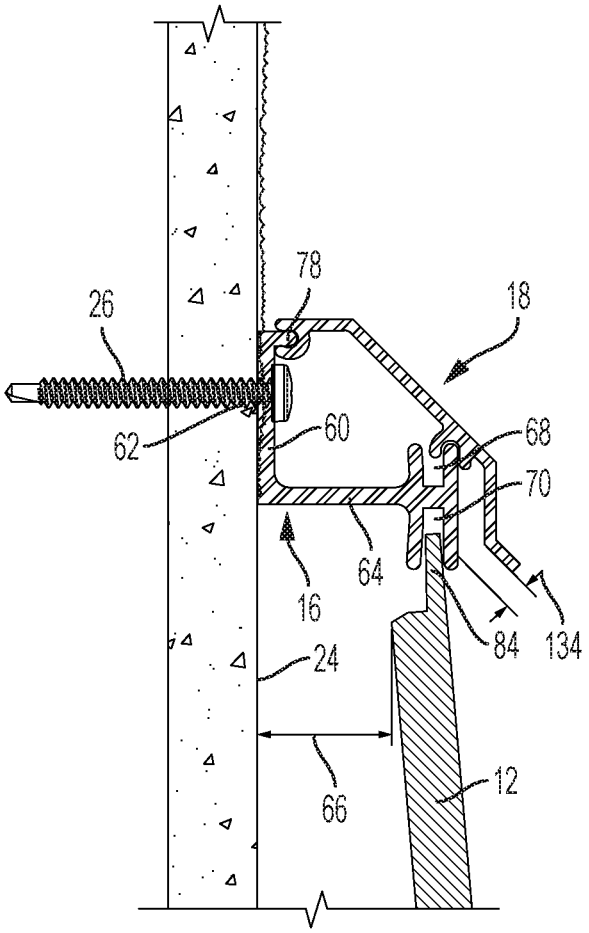
FIG. 3 illustrates another cross-section of the wall siding system shown in FIG. 1.
Figure 3A:
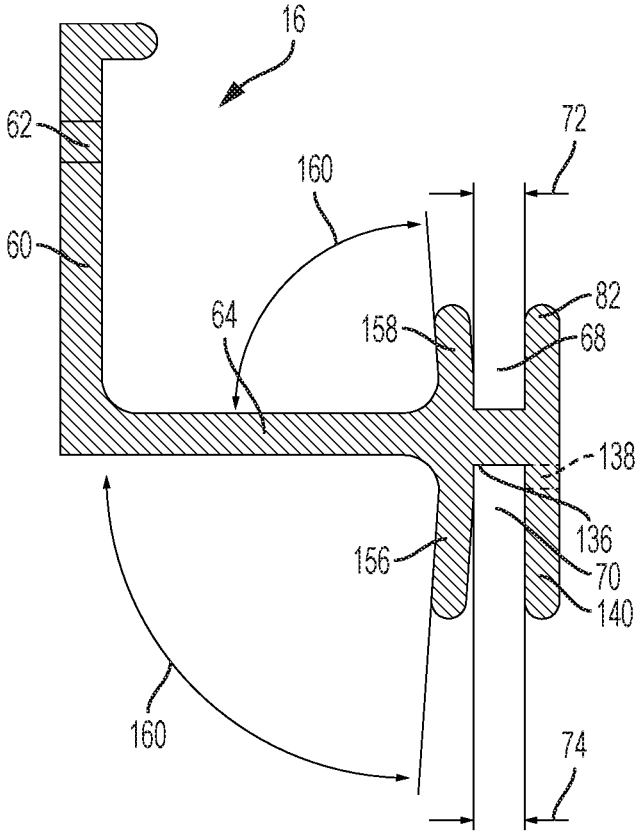
FIG. 3A illustrates a cross-section of a short clip of the wall siding system.
Figure 5:
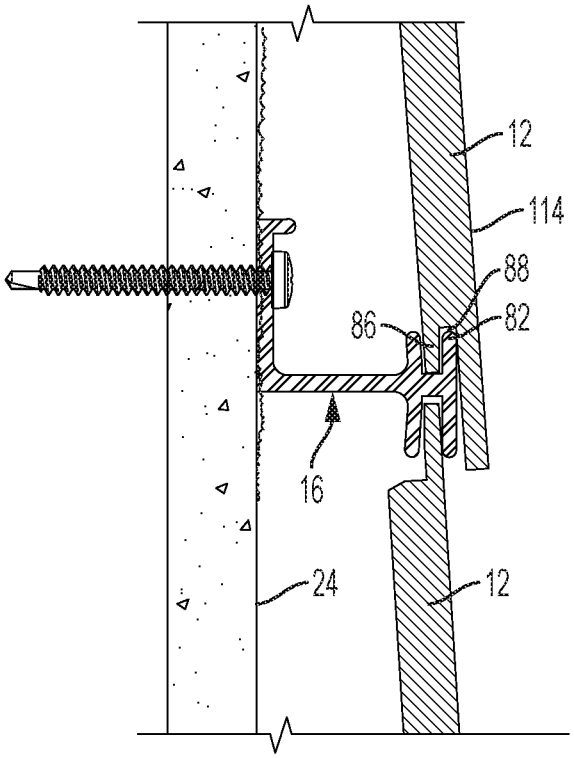
FIG. 5 illustrates another cross-section of the wall siding system shown in FIG. 1.

Referring now to FIGS. 3, 3A and 5, the horizontal joint clip 16 is shown. The horizontal joint clip 16 is used to secure the upper end of the panel 12. In particular, the horizontal joint clip 16 has a back plate 60 with one or more holes 62 for receiving wall fasteners 26 to secure the horizontal joint clip 16 to the vertical surface 24. The horizontal joint clip 16 additionally has an offset plate 64 that ensures a minimum gap 66 (see FIG. 3) between the panel 12 and the vertical surface 24. The horizontal joint clip 16 may have first and second grooves 68, 70 that extend outwardly in opposing directions as shown in FIG. 3A. The first and second grooves 68, 70 may open in a direction that is generally parallel to the back plate 60 of the horizontal joint clip 16.

A width 72 of the first groove 68 may be equal to or different than a width 74 of the second groove 70. Preferably, the width 72 of the first groove 68 is generally equal to the width 74 of the second groove 70. The width 72, 74 of the first and second grooves 68, 70 may be slightly larger than the width 52 of the rear wall 48 and the tongue 84 of the panel 12. In particular, the width 72, 74 of the first and second grooves 68, 70 may be about 0.115 inches.

Figure 3B:
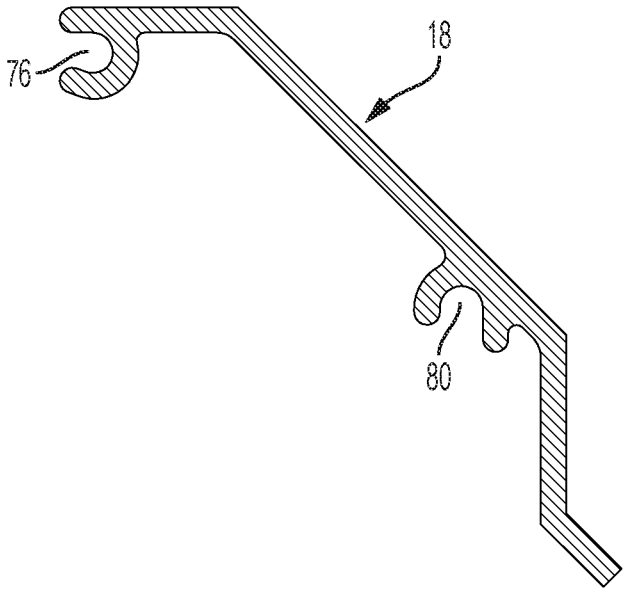
FIG. 3B illustrates a cross-section of a top cap of the wall siding system.

The horizontal joint clip 16 may be utilized to secure the upper end of a lower panel 12 to a lower end of an upper panel 12, as shown in FIG. 5. Alternatively, the horizontal joint clip 16 may be utilized to secure the upper end of the uppermost panel 12, as shown in FIG. 3. A length of the horizontal joint clip 16 may be about 1 inch to 1 feet, and is preferably about 3 inches long. More importantly, the joint clip 16 does not extend across the entire width of the panel 12 so that air can still flow behind the panels vertically between joint clips 16 that are spaced apart from each other. The top cap 18 may be secured to the top of the horizontal joint clip 16 to hide the grooves 68, 70, fastener 26 and the horizontal joint clip 16 in general. The top cap 18 may be fitted in place by inserting a first groove 76 into a lip 78 and a second groove 80 into one of the walls 82 that define the first groove 68. See FIG. 3B. The top cap 18 may snap into place and may be retained therein by an interference fit. The top cap 18 extends a substantial length along the wall. The top cap 18 is gapped 134 away from the short clips 16 by about ¼ of an inch. Because the clips 16 do not extend across the entire length but are spaced apart from each other, the ¼ inch gap allows air to flow under the top cap 18 in between the short clips 16 and ultimately flow air behind the panels 12.

Figure 2:
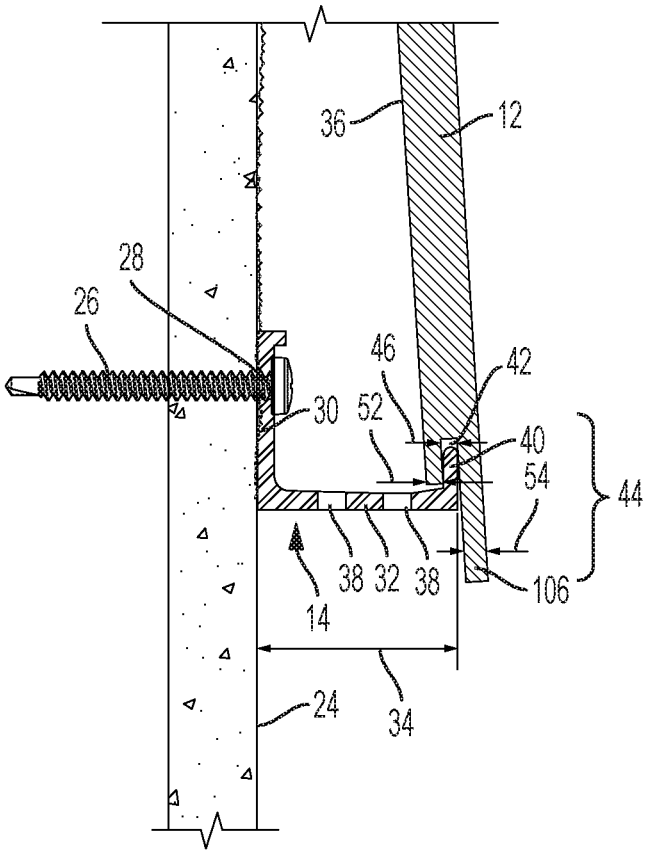
FIG. 2 illustrates a cross-section of the wall siding system shown in FIG. 1.
Figure 2A:
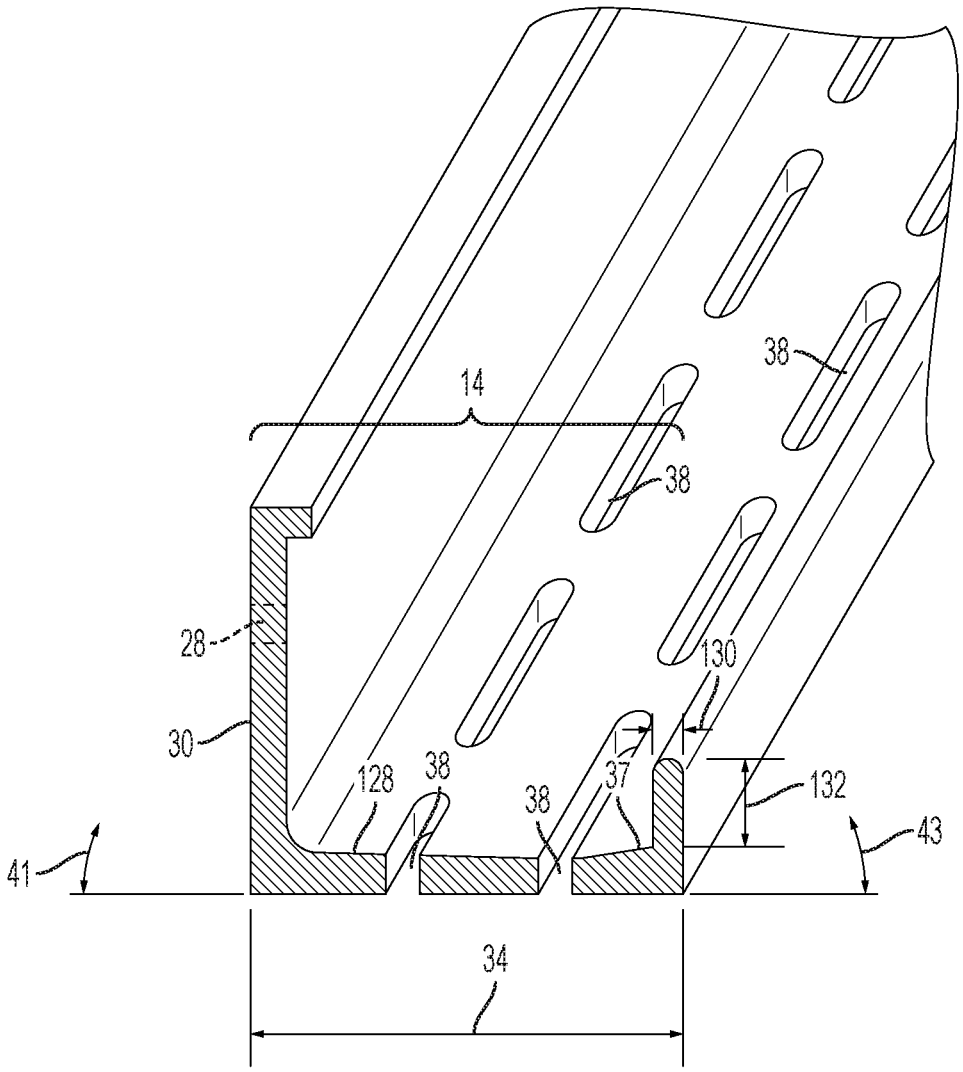
FIG. 2A illustrates a cross-section of a bottom rail of the wall siding system.
Figure 43:
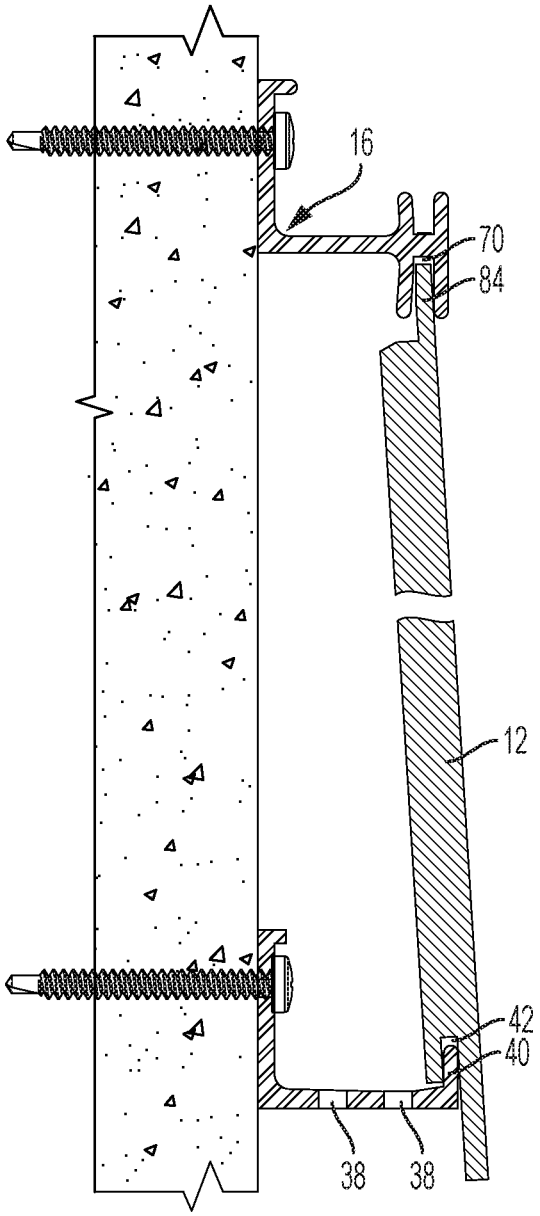
FIG. 43 illustrates a cross-sectional view of the short clip, panel and bottom rail with the panel being tilted so that vertically adjacent panels appear to be lapped over one another and the panels are oriented in a horizontal orientation.

The panel 12 may have a groove formed on its bottom end as shown in FIG. 2 and a tongue 84 formed on its top end as shown in FIG. 3. Since the groove 42 at the bottom end of the panel 12 is at the center and the tongue 84 is at a front side of the panel 12 at its top end, the panel is tilted backward as shown in FIGS. 2, 3 and 43. The upward extending tongue 40 is received into the groove 42 and the tongue 84 of the panel 12 is inserted into the second groove 70 of the horizontal joint clip 16. If additional panels are stacked upon the lower panels 12, then the top cap 18 is not installed. Rather, as shown in FIG. 5, another panel 12 is engaged to the top of the horizontal joint clip 16. In particular, the lower end of the panel 12 has a tongue 86 that is received into the first groove 68 (see FIG. 3A). Alternatively, it is also contemplated that the groove 88 formed at the bottom end of the panel 12 may be received into the wall 82 that defines the first groove 68. Additional horizontal joint clips 16 may be attached to the top end of the panel 12 in the same manner as that of the lower panels 12. The process may be repeated until the topmost panel is installed and held by the horizontal joint clip 16.

The tongue 84 of the panel 12 does not extend fully into the groove 70 of the clip 16. Rather, there may be a small gap between the upper end of the tongue 84 of the panel 12 and the bottommost recess surface 136 of the groove 70. Preferably, there is an approximately ¼ inch gap there between. The gap may be formed by placing a ¼ inch thick spacer into an aperture 138 formed in the front wall 140 that defines the groove 70. This is shown in FIG. 3A. By inserting the ¼ inch thick spacer into the aperture 138, the top end of the tongue 84 is gapped away from the bottommost recess surface 136. The clip 16 is secured to the wall with the fastener 26 that is inserted into the aperture 62 of the back plate 60. The panel 12 may be cut to length to form the edge 96 of the wall panel 12 on the job site.

Figure 19:
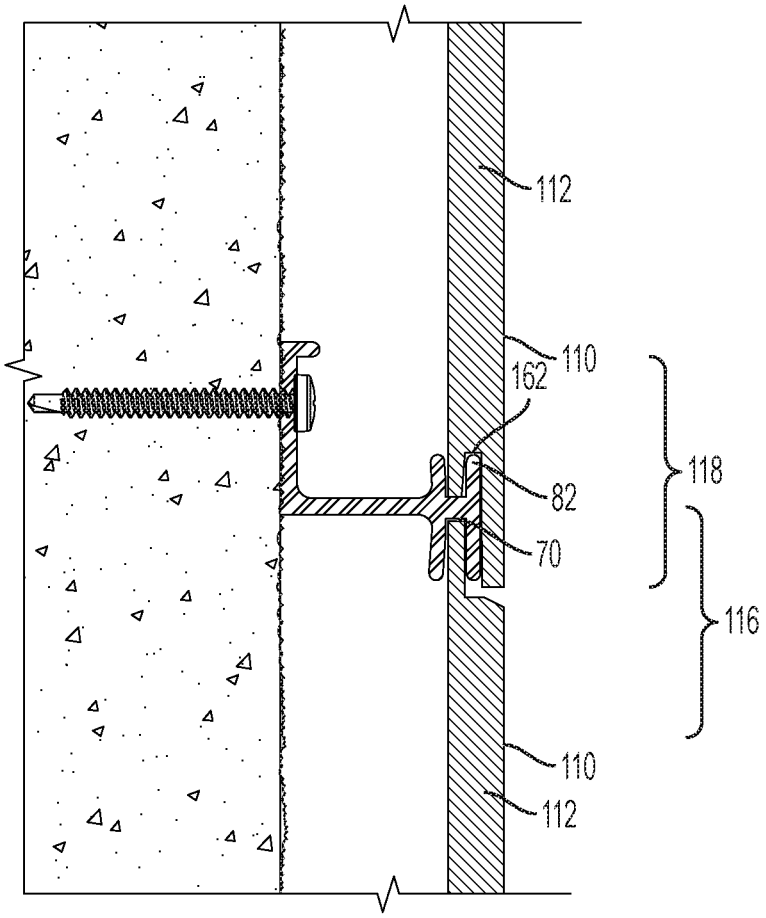
FIG. 19 illustrates another cross-section of the wall siding system shown in FIG. 15.
Figure 33:
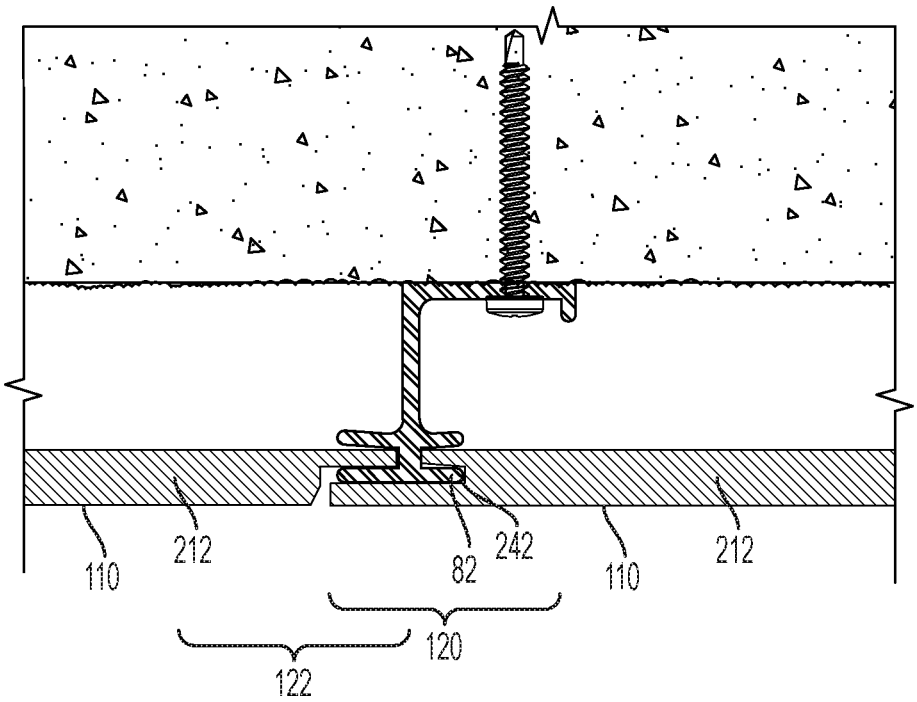
FIG. 33 illustrates another cross-section of the wall siding system shown in FIG. 29.

Referring back to FIG. 3A, the groove 70 is formed by the front wall 140 and a rear wall 156. Also, the front wall 140 may be coplanar with the wall 82 that defines the groove 68. The groove 68 may be defined by rear wall 158. The rear walls 156, 158 may be angularly offset with the front walls 140, 82 by 4 degrees plus or minus up to about 3 degrees. With respect to the offset plate 64, the rear walls 156, 158 may be angularly offset 160 to the extension plate 64 by 86 degrees plus or minus 3 degrees. The rear walls 156, 158 may also have rounded ends. This configuration helps in allowing the panel 12 to be tilted as shown in FIG. 5 or vertical as shown in FIG. 19 and FIG. 33.

The top cap 18 is installed onto the horizontal joint clip 16 securing the top end of the topmost panel 12. This finishes the wall at the top side of the wall siding system 10.

Figure 4:
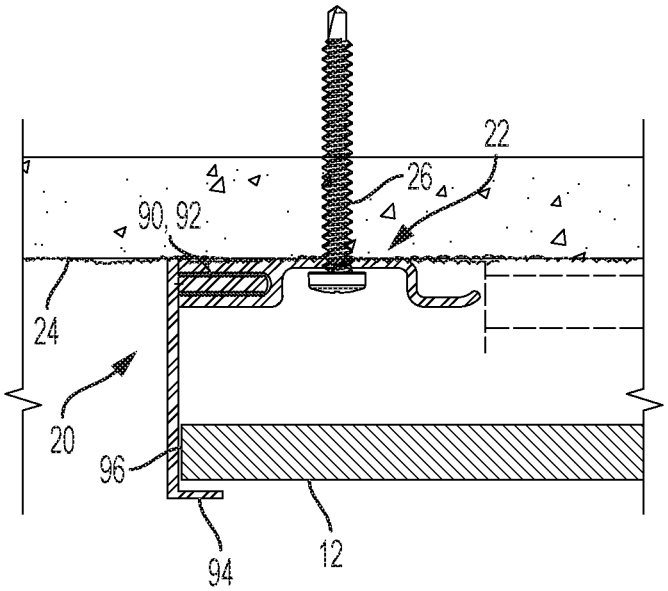
FIG. 4 illustrates another cross-section of the wall siding system shown in FIG. 1.

Referring now to FIG. 4, a side edge of the plurality of wall panels 12 may be finished with the edge trim 20. The edge trim 20 may be secured to the wall with a trim cleat 22. The trim cleat 22 may have a serrated groove 90 that receives a serrated tongue 92. Silicon may be squeezed into the groove 91 and the tongue 92 inserted therein. The silicone after drying, retains the edge trim 20 on the trim cleat 22. The trim cleat 22 may be secured to the vertical surface 24 with wall fastener 26. Edge trim 20 may have a return 94 that hides the edge 96 of the wall panel 12.

Figure 6:
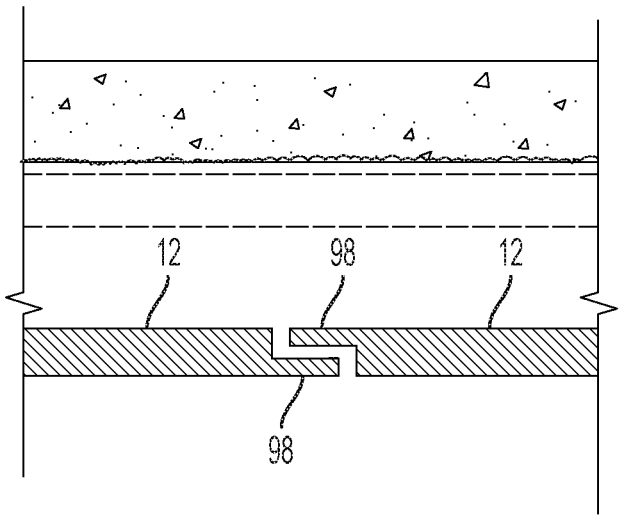
FIG. 6 illustrates another cross-section of the wall siding system shown in FIG. 1.
Figure 7:
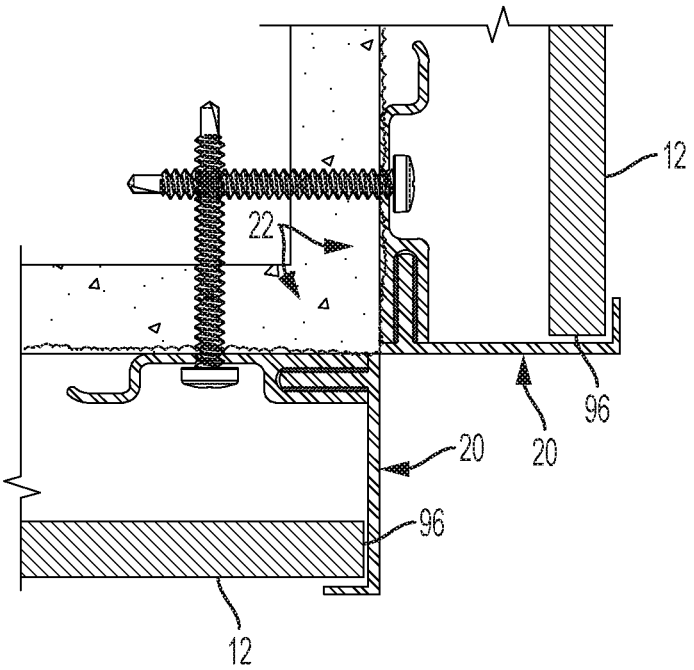
FIG. 7 illustrates another cross-section of the wall siding system shown in FIG. 1.
Figure 8:
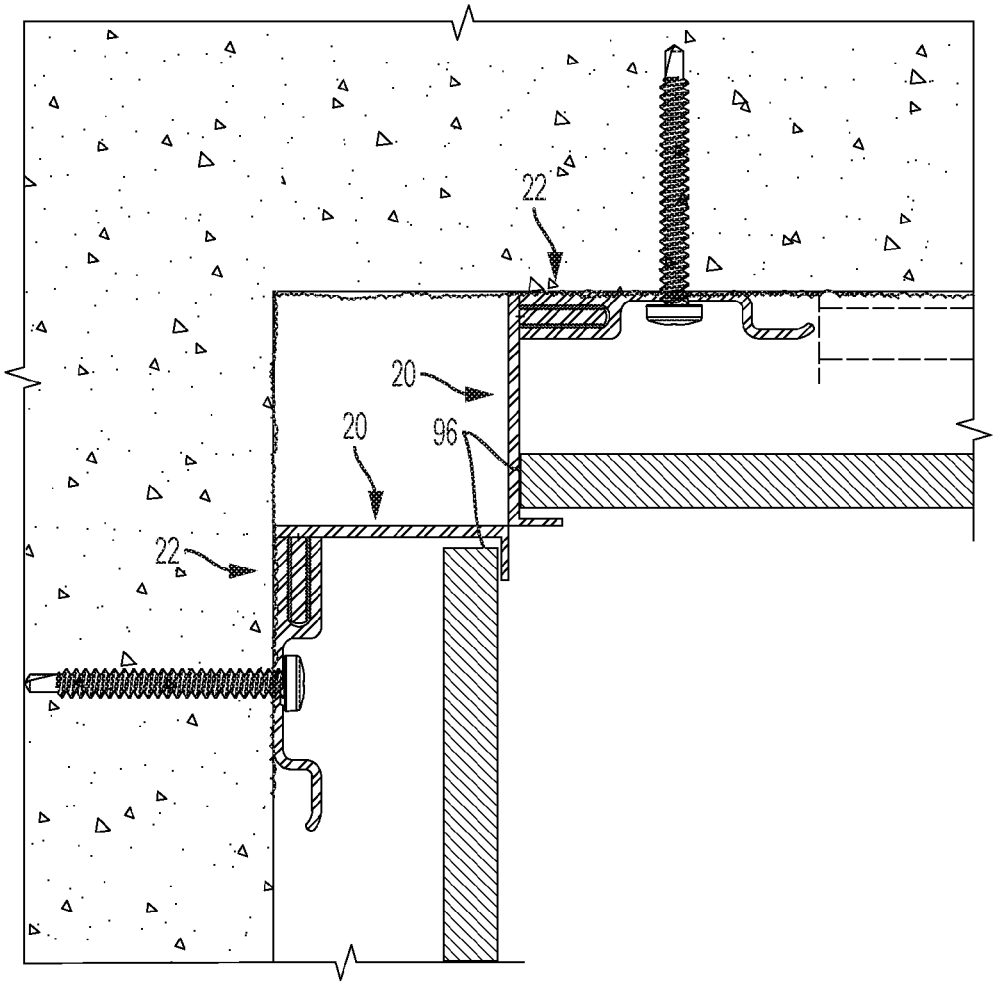
FIG. 8 illustrates another cross-section of the wall siding system shown in FIG. 1.

Referring now to FIG. 6, when two panels 12 butt up against each other, the ends may be formed with overlapping tongues 98. Referring now to FIG. 7, an outside corner is shown. The outside corner may be finished with two sets of edge trim 20 and trim cleat 22. The panels 12 may be cut to length on the job site to form edges 96. Referring now to FIG. 8, an inside corner is shown finished with two sets of edge trim 20 and trim cleat 22. Once again, the panels 12 may be cut to length on the job site to form edges 96.

Figure 9:
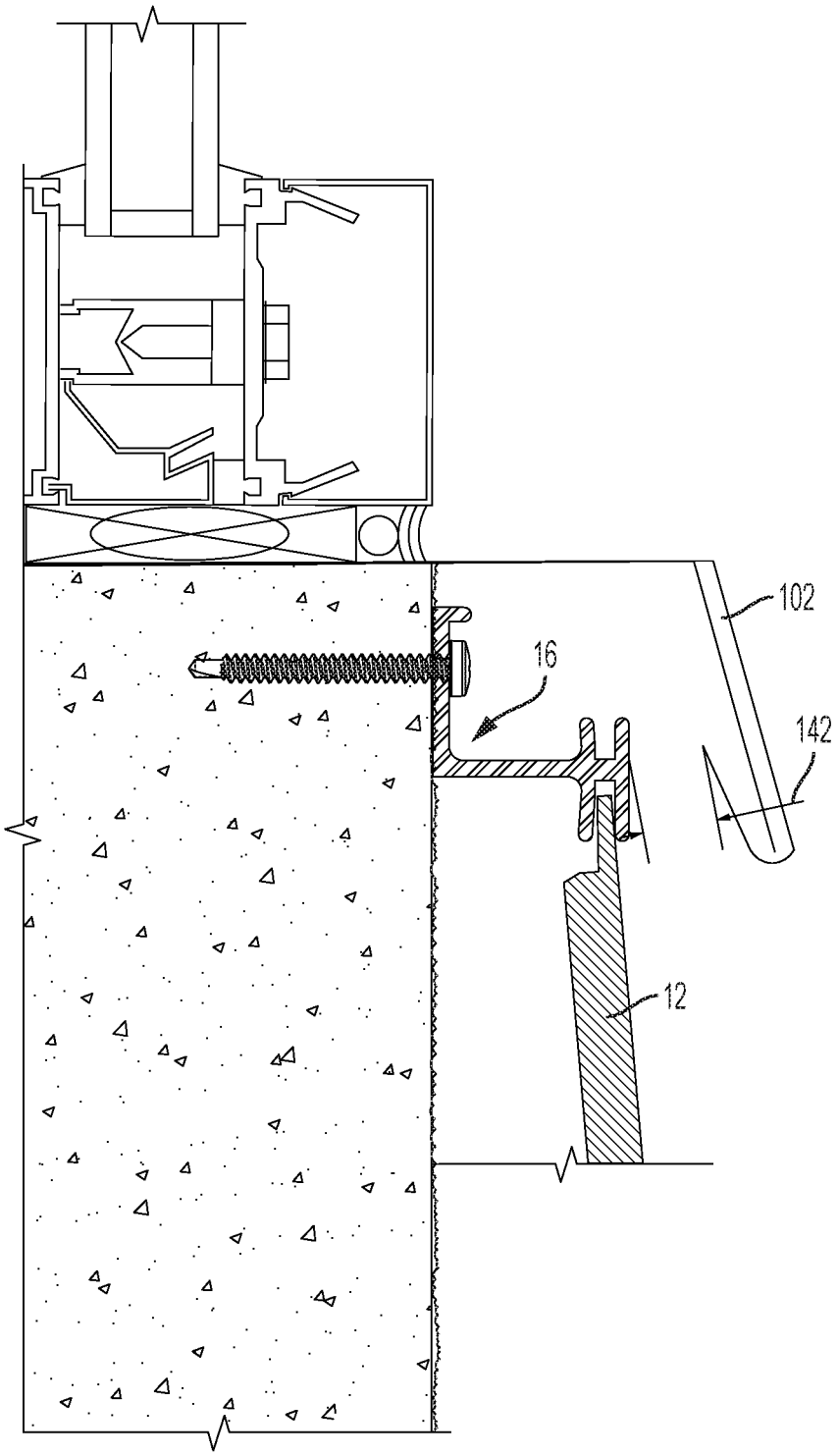
FIG. 9 illustrates another cross-section of the wall siding system shown in FIG. 1.
Figure 10:
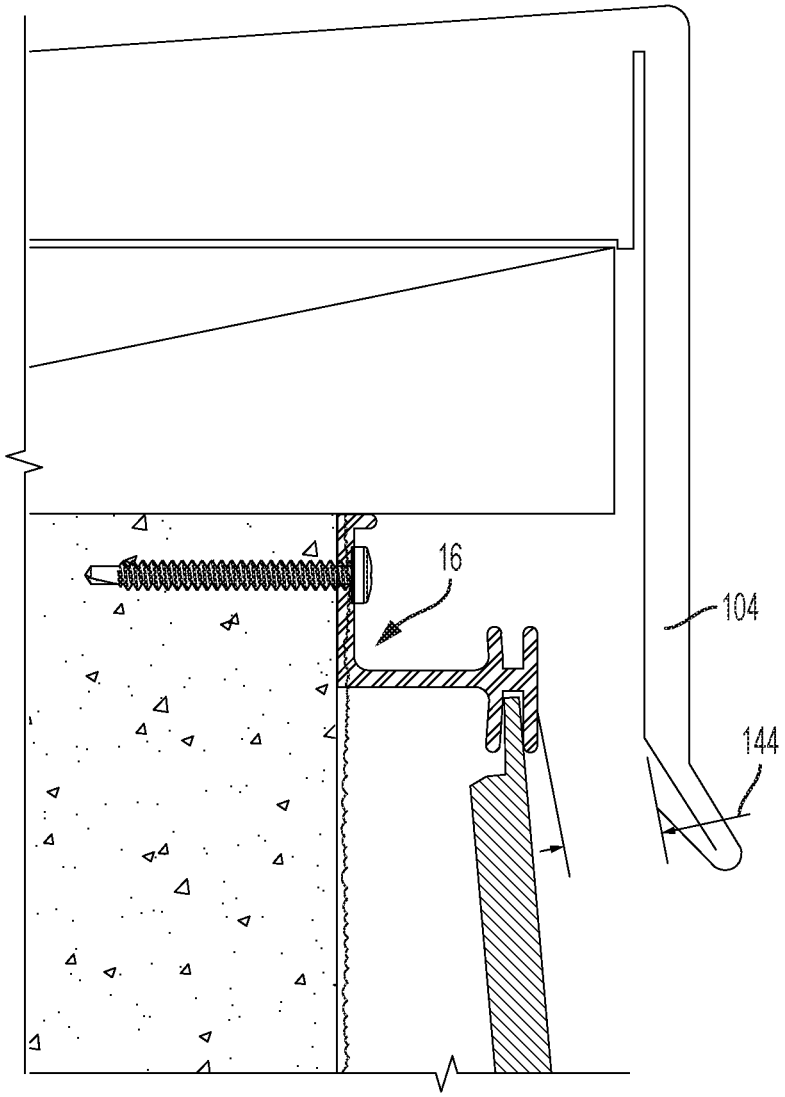
FIG. 10 illustrates another cross-section of the wall siding system shown in FIG. 1.
Figure 11:
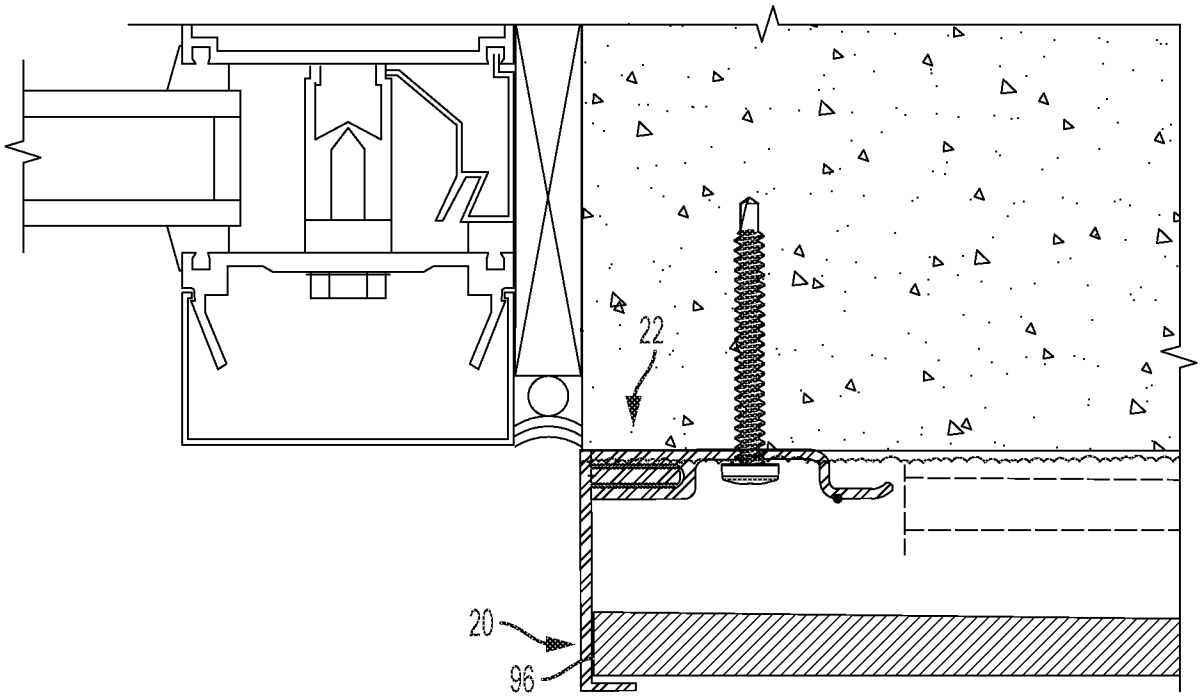
FIG. 11 illustrates another cross-section of the wall siding system shown in FIG. 1.
Figure 12:
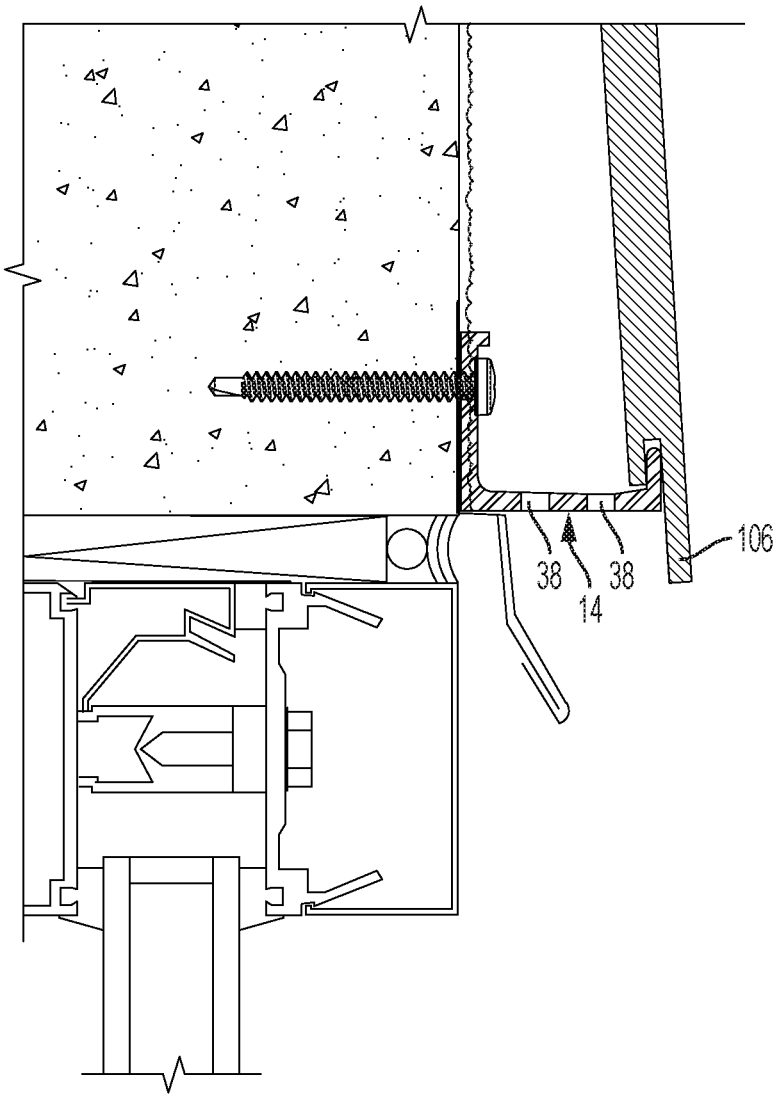
FIG. 12 illustrates another cross-section of the wall siding system shown in FIG. 1.
Figure 13:
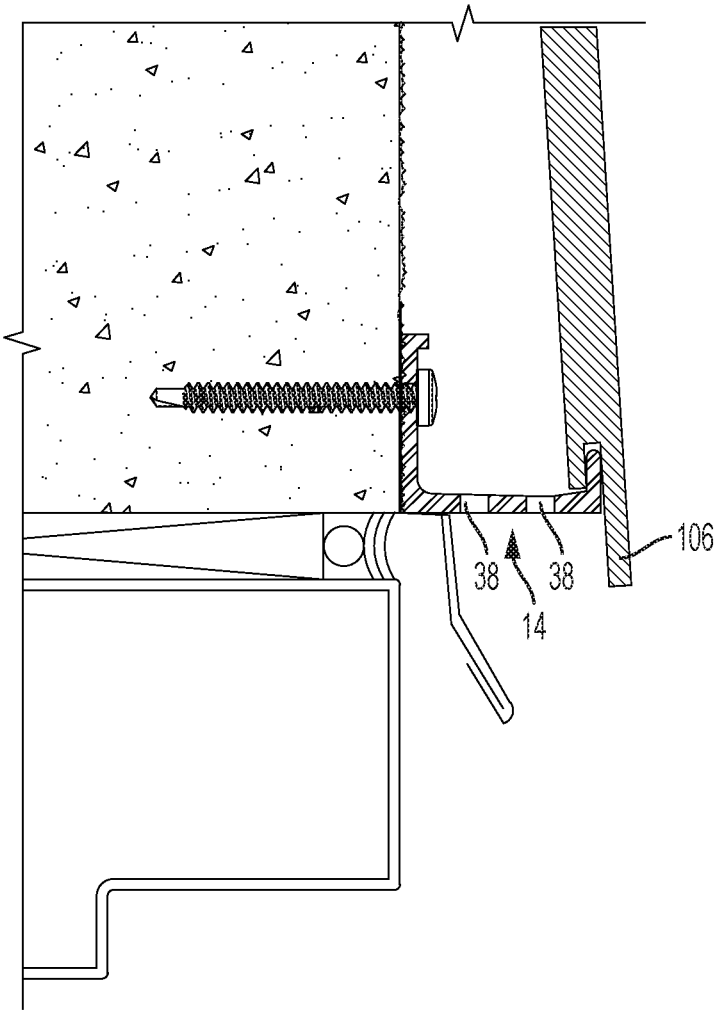
FIG. 13 illustrates another cross-section of the wall siding system shown in FIG. 1.
Figure 14:
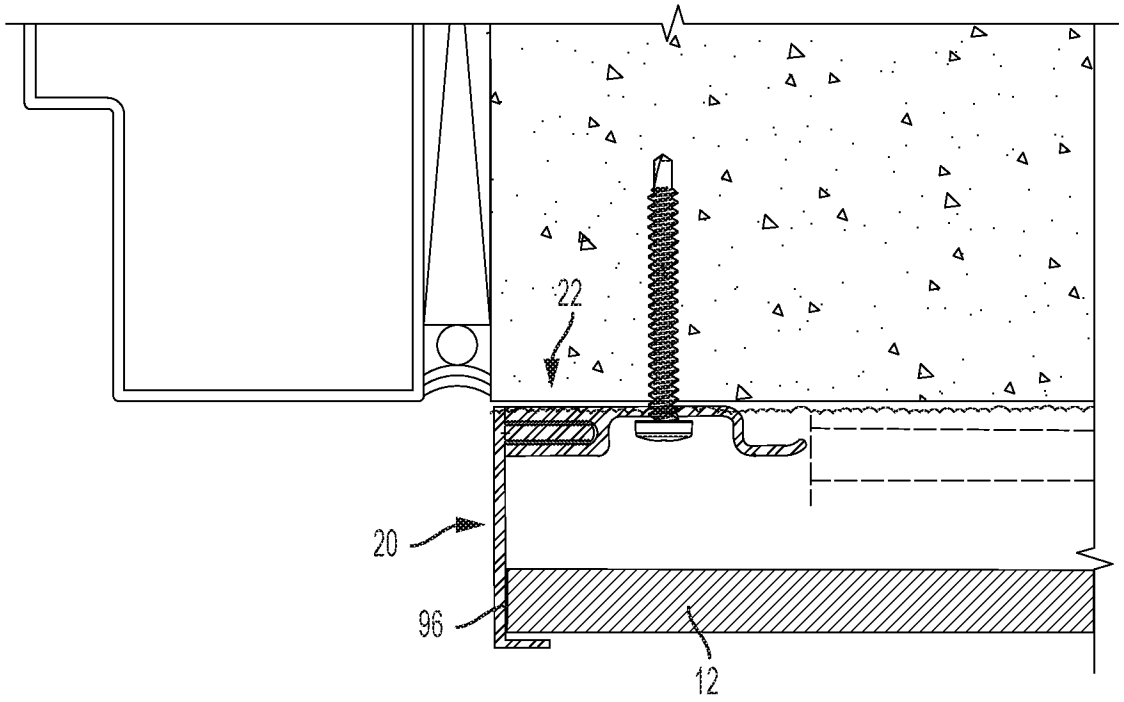
FIG. 14 illustrates another cross-section of the wall siding system shown in FIG. 1.

Referring now to FIG. 9, a bottom edge of the window is shown. The bottom edge of the window may hide the horizontal joint clip 16 with the flashing 102. The flashing 102 may be gapped away 142 to allow air to flow under the flashing 102 in between the short clips 16 and behind the panels 12 to dry out any water that might be behind the panels 12. Referring now to FIG. 10, the top edge of the surface 24 is shown. The top edge may be finished as shown in FIG. 3 or finished as shown in FIG. 10. In lieu of the top cap 18, the uppermost horizontal joint clip 16 may be hidden with a flashing 104. The flashing 104 may be gapped away 144 to allow air to flow under the flashing 104 in between the short clips 16 and behind the panels 12 to dry out any water that might be behind the panels 12. Referring now to FIG. 11, a side of the window is shown. The side of the window may be finished with the edge trim 20 and the trim cleat 22. The panel 12 may be cut to length on the job site to form edge 96. Referring now to FIG. 12, a top edge of the window is shown. The top edge of the window may be finished with the bottom rail 14. The front of the panel has an extension 106 that hides the bottom rail 14. FIG. 13 illustrates a top edge of the door which is finished in the same manner as that shown in FIG. 12. The side jam of the door is also finished with the edge trim 20 and trim cleat 22, as shown in FIG. 14. The panel 12 may be cut to length on the job site to form edge 96.

Figure 20:
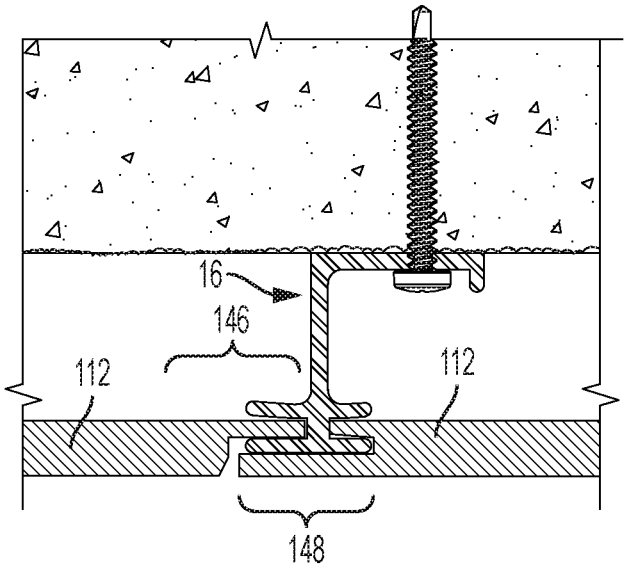
FIG. 20 illustrates another cross-section of the wall siding system shown in FIG. 15.

Referring now to FIGS. 15-28, the wall siding system 100 is shown. The panels 112 are flush with each other as shown in FIG. 19 and not designed to appear to be lapped over one another, as shown in the wall siding system 10 shown in FIGS. 1-14. The wall siding system 100 shares the same attributes (e.g., method of install, structure and all other aspects as well) as the wall siding system 10 except for the top end of the panels 12, 112. Additionally, the end portions of the panels 112 are different than the end portions of the panels 12. In particular, comparing FIGS. 6 and 20, the end portions of the panels 12 shown in FIG. 6 are not engaged to each other except by having overlapping tongues 98. In contrast, in reference to FIG. 20, the end portions 146, 148 of the panels 112 are identical to top and bottom side longitudinal edges 116, 118 (see FIG. 19) so that they 146, 148 engage the clip 16. The clip 16 may be oriented 90° in FIG. 20 compared to the clip 16 shown in FIG. 19. In this regard, the panels 112 may be held together on all four sides of the panels 12 with the clips 16 or collectively with the clips 16 and the bottom rail 14. The formation of the end portions 146, 148 of the panels 112, as that shown in FIG. 20, is optional. It is also contemplated that the end portions 146, 148 may have overlapping tongues 98 identical to the overlapping tongues 98 shown in FIG. 6.

The panels 112 are flush with each other as shown in FIG. 33. In particular, this means that the front surface 110 of one of the panels 112 is coplanar with the front surface 110 of the other panel 112. The panels 12 shown in FIG. 5 appear to be lapped over one another. This means that the front surface 114 of one of the panels 12 is tilted and the front surface 114 of the other panel 12 is tilted in the same direction so that the panels 12 appear to be lapped over one another. Panels 112 have a different configuration compared to that of the panel 12. In particular, the top end has a tongue 108 on a backside of the panel 12. The second groove 70 is spaced apart from the surface 24 in relation to the vertically extending tongue 40 so that when the panels 12 are mounted to the bottom rail 14 and the horizontal joint clips 16, the panels 12 have the lapped appearance, whereas, when the panels 112 are mounted to the bottom rail 14 and the horizontal joint clips 16, the panels 112 have a flush appearance. Panels 112 are mounted to the surface 24 with the same hardware, namely, the bottom rail 14 and the horizontal joint clip 16. The other miscellaneous hardware including but not limited to the top cap 18, the edge trim 20 and the trim cleat 22 may also be used to finish the wall siding system 100. The other miscellaneous hardware is the same hardware used in both the wall siding system 10, 100 and 200.

Figure 17:
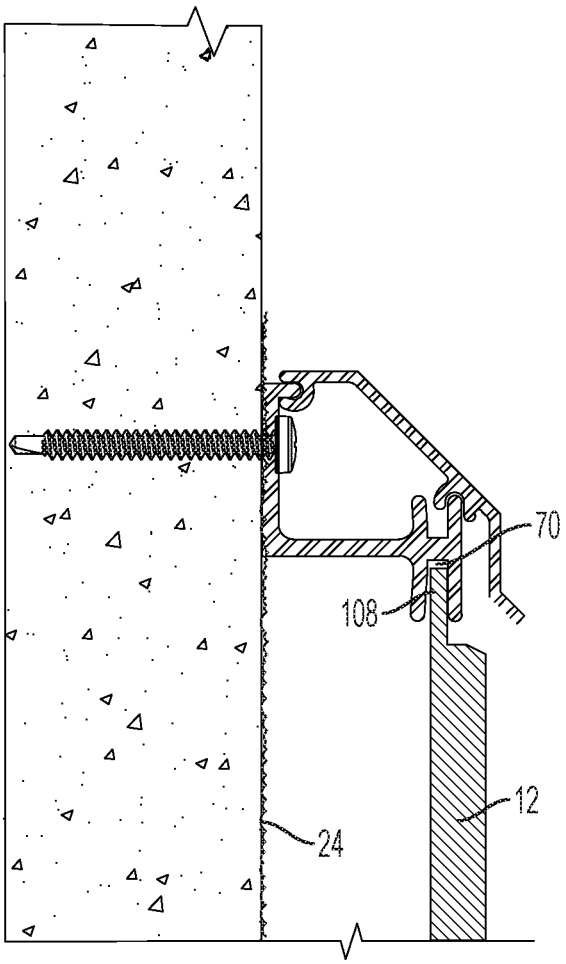
FIG. 17 illustrates another cross-section of the wall siding system shown in FIG. 15.
Figure 18:
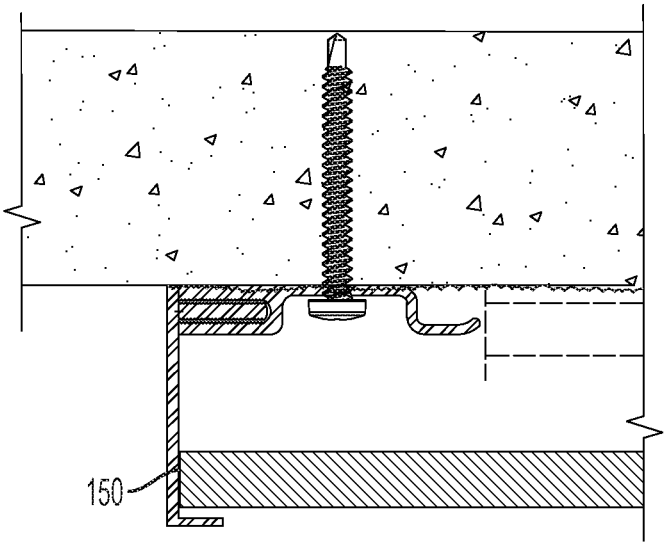
FIG. 18 illustrates another cross-section of the wall siding system shown in FIG. 15.
Figure 21:
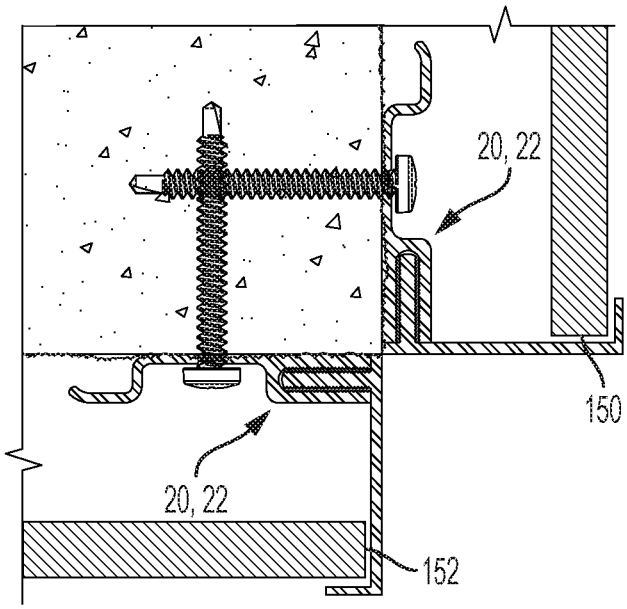
FIG. 21 illustrates another cross-section of the wall siding system shown in FIG. 15.
Figure 22:
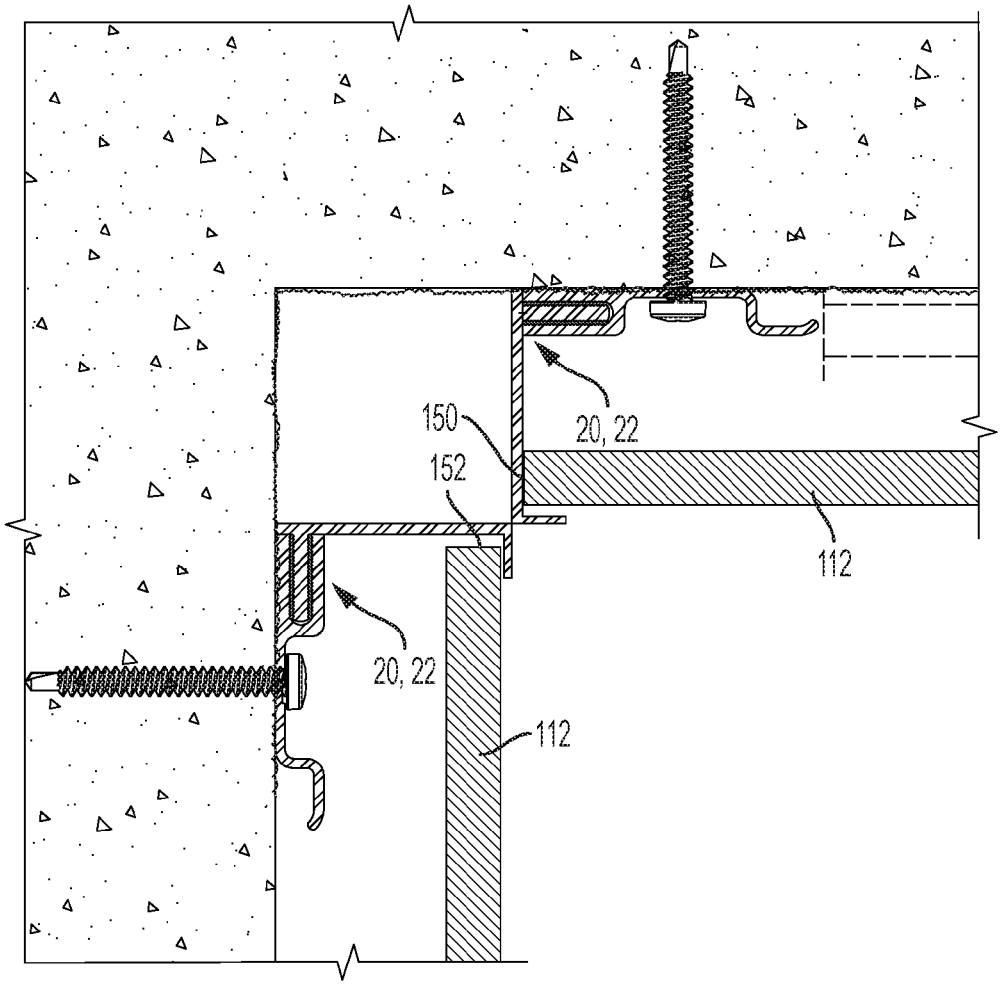
FIG. 22 illustrates another cross-section of the wall siding system shown in FIG. 15.
Figure 23:
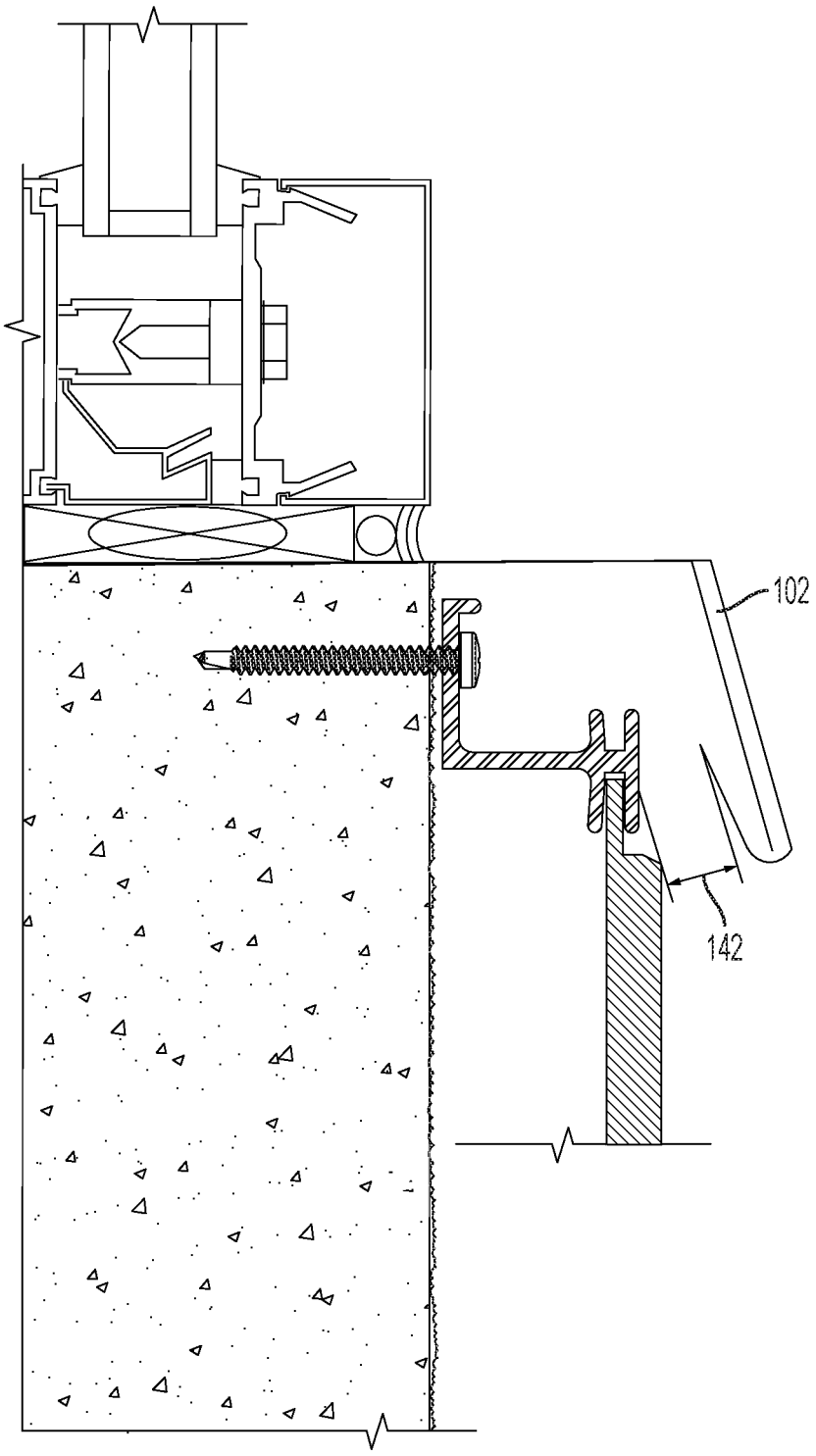
FIG. 23 illustrates another cross-section of the wall siding system shown in FIG. 15.
Figure 24:
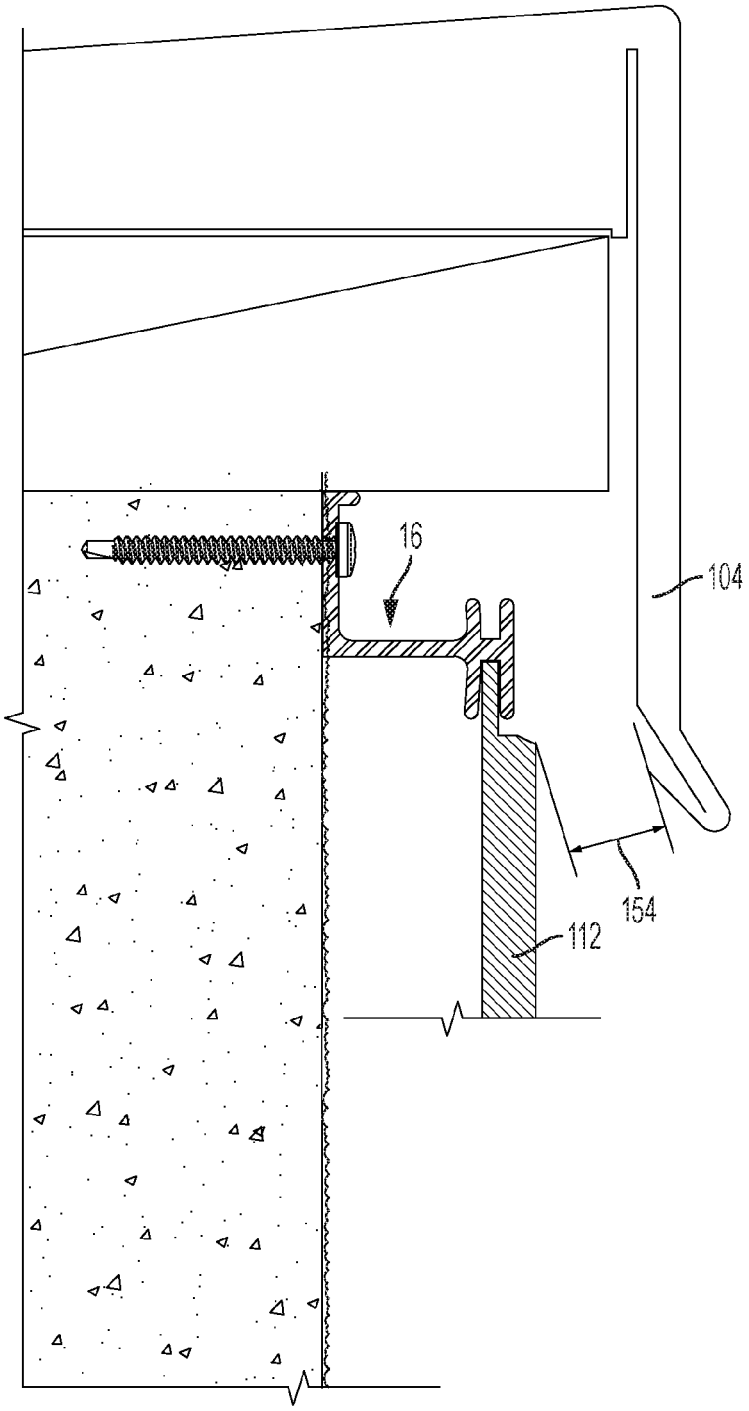
FIG. 24 illustrates another cross-section of the wall siding system shown in FIG. 15.
Figure 25:
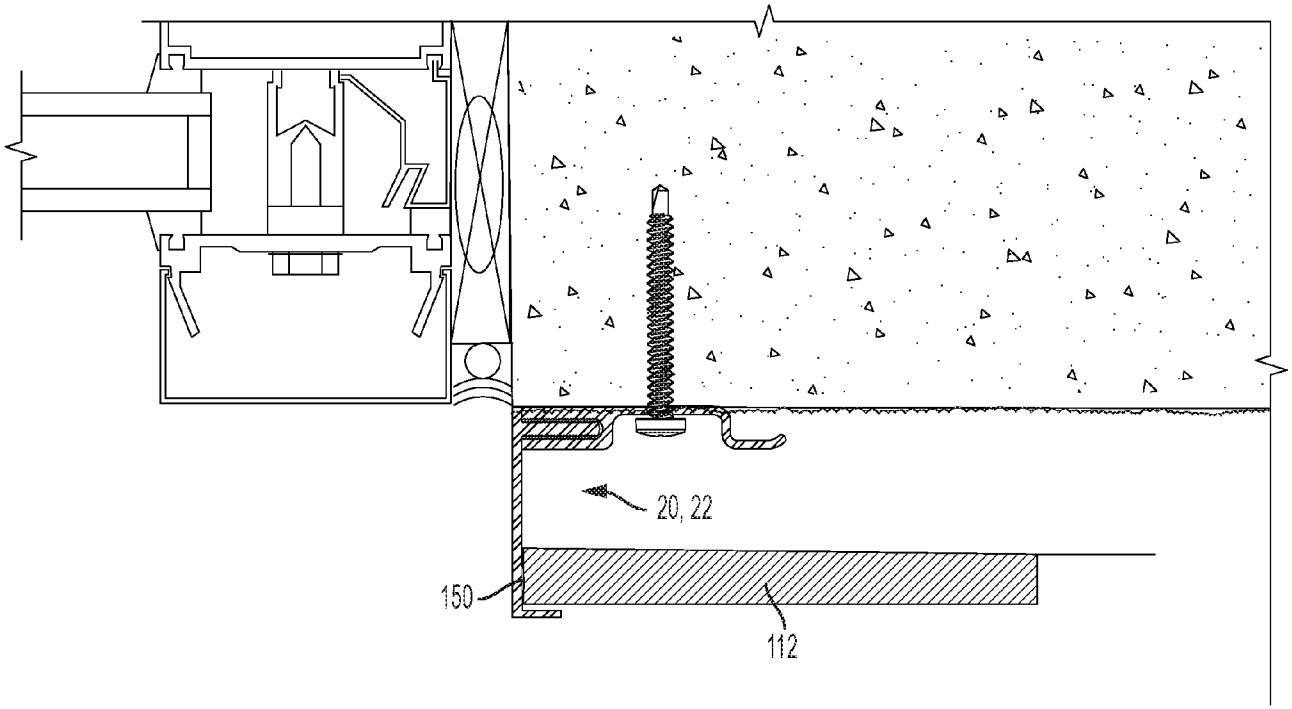
FIG. 25 illustrates another cross-section of the wall siding system shown in FIG. 15.
Figure 26:
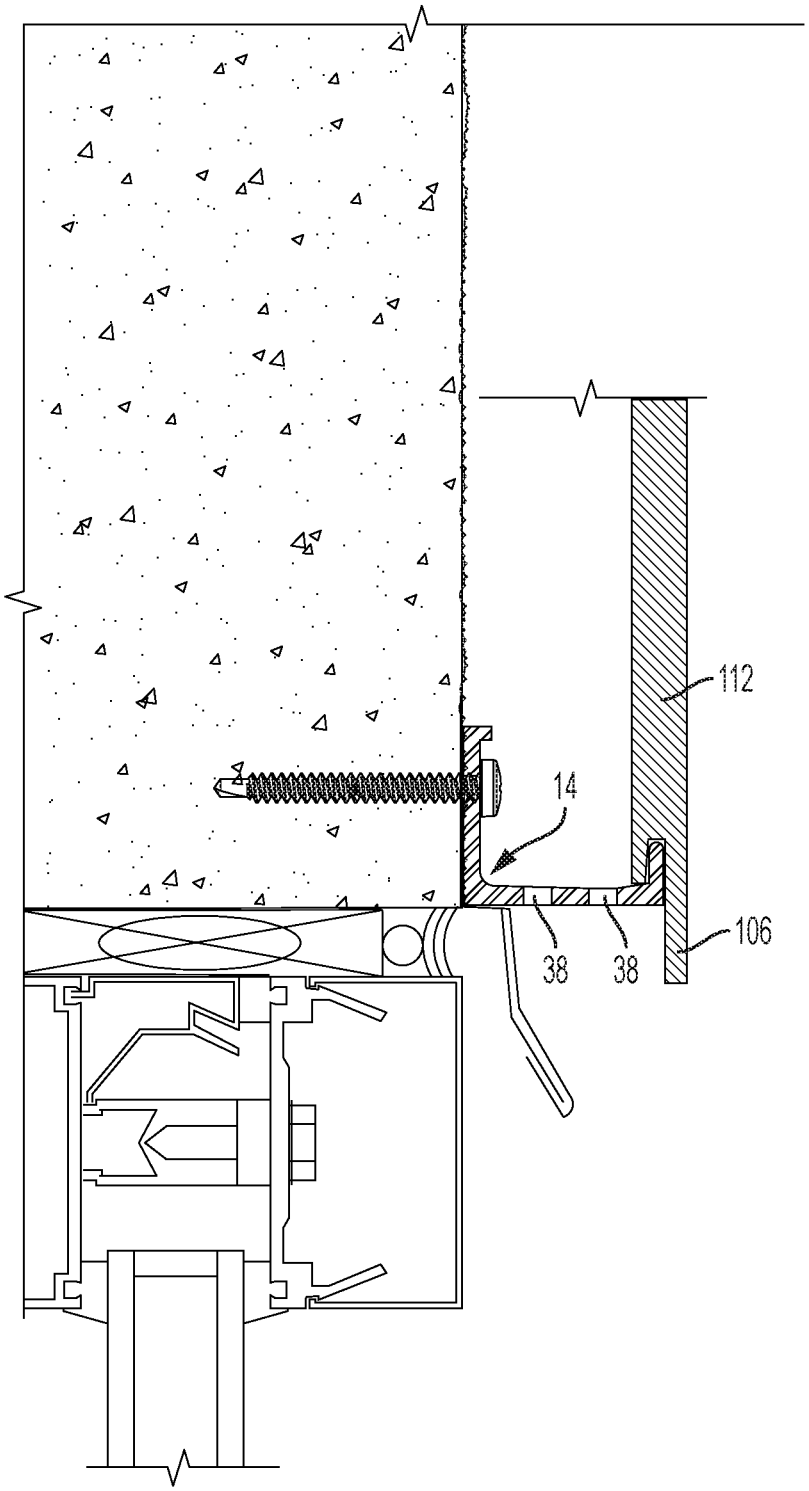
FIG. 26 illustrates another cross-section of the wall siding system shown in FIG. 15.
Figure 27:
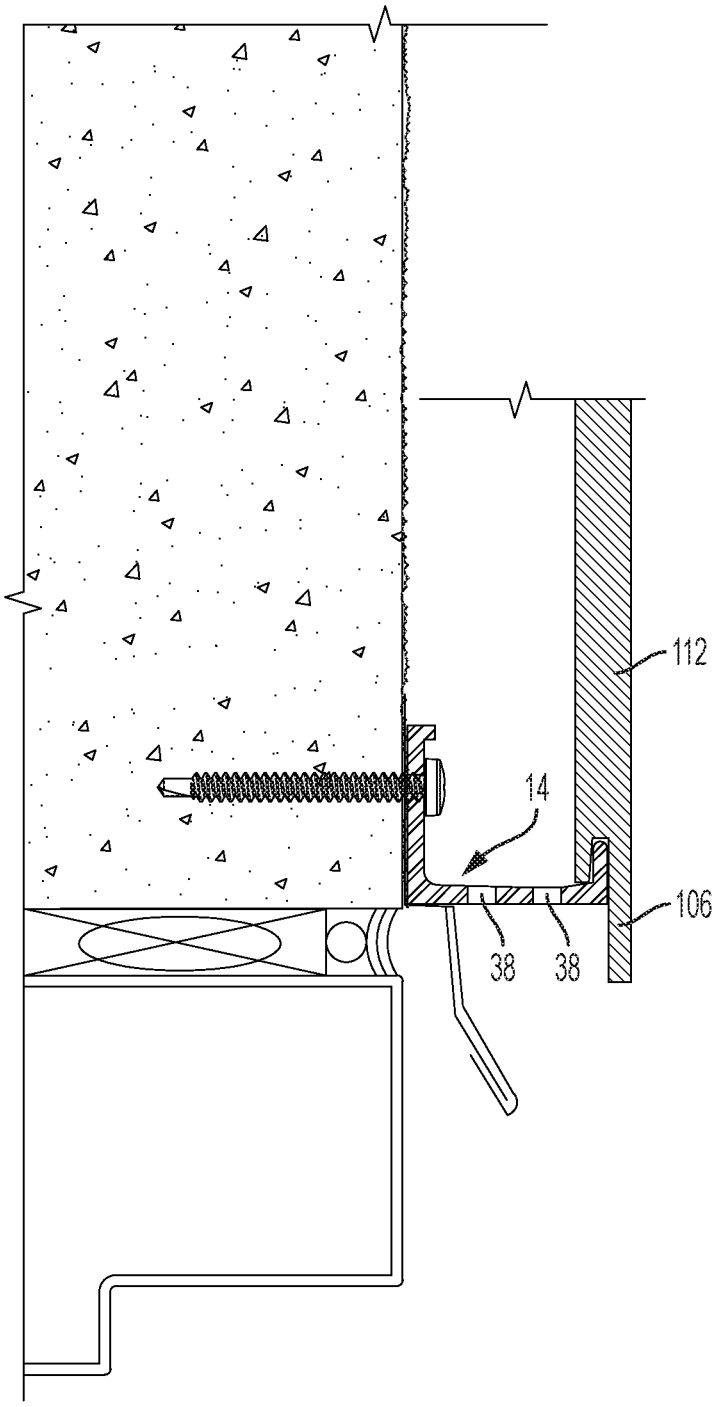
FIG. 27 illustrates another cross-section of the wall siding system shown in FIG. 15.
Figure 28:
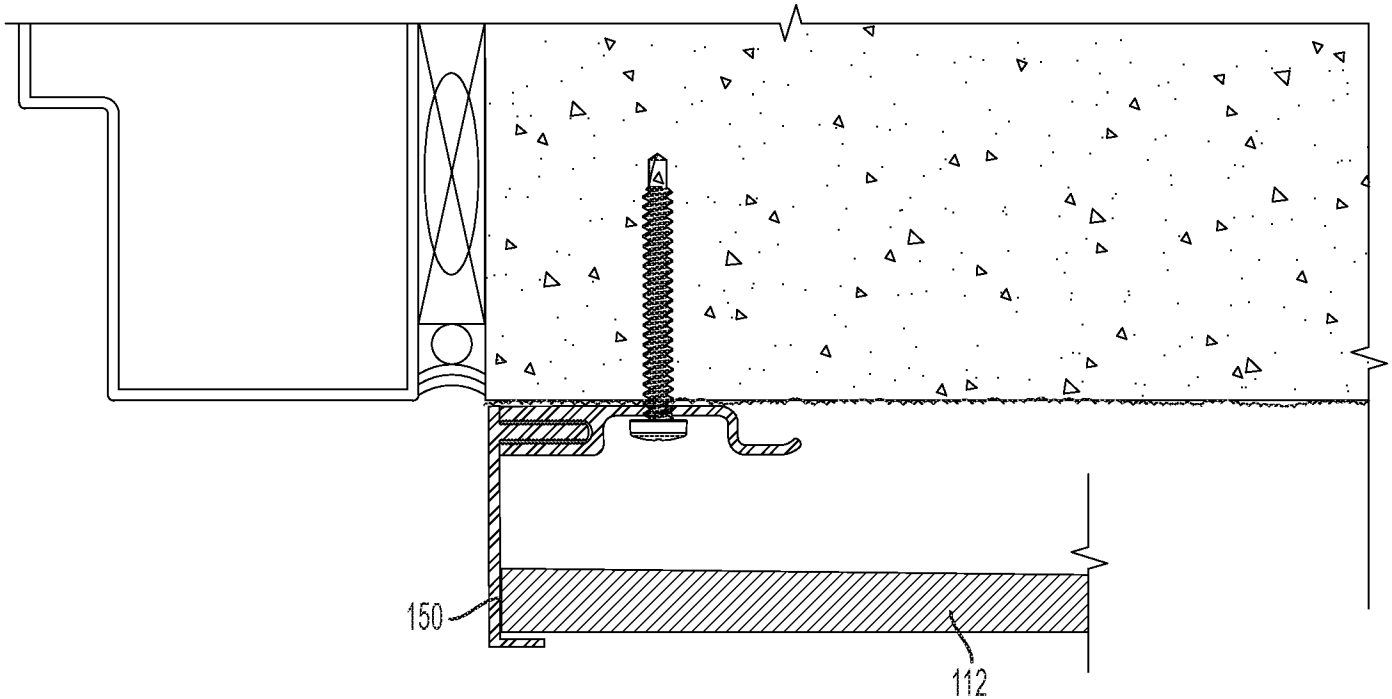
FIG. 28 illustrates another cross-section of the wall siding system shown in FIG. 15.

Referring to FIG. 18, a side edge of the plurality of wall panels 112 may be finished with the edge trim 20 and secured to the wall with the trim cleat 22, as discussed above in relation to FIG. 4. The panel 112 may be cut to length on the job site to form edges 150. Referring now to FIG. 21, an outside corner is shown. The outside corner may be finished with two sets of edge trim 20 and trim cleat 22. The panels 112 may be cut to length on the job site to form edges 150, 152. Referring now to FIG. 22, an inside corner is shown. The inside corner may be finished with two sets of edge trims 20 and trim cleat 22. The panels 112 may be cut to length on the job site to form edges 150, 152. Referring now to FIG. 23, a bottom edge of the window is shown. The bottom edge of the window may hide the horizontal joint clip 16 with the flashing 102. The flashing 102 may be gapped away 142 to allow air to flow under the flashing 102 in between the short clips 16 and behind the panels 112 to dry out any water that might be behind the panels 112. Referring now to FIG. 24, the top edge of the surface 24 is shown. The top edge may be finished as shown in FIG. 17 or as shown in FIG. 24. Instead of the top cap 18, the uppermost horizontal joint clip 16 may be hidden with the flashing 104. The flashing 104 may be gapped away 154 to allow air to flow under the flashing 104 in between the short clips 16 and behind the panels 112 to dry out any water that might be behind the panels 12. Referring now to FIG. 25, a side of the window is shown. The side of the window may be finished with edge trim the 20 and the trim cleat 22. The panel 112 may be cut to length on the job site to form edge 150. Referring now to FIG. 26, a top edge of the window is shown. The top edge of the window may be finished with the bottom rail 14. The front of the panel 112 may have the extension 106 that hides the bottom rail 14. Referring now to FIG. 27, a top edge of the door is shown. The top edge of the door may be finished with in the same manner as that shown in FIG. 26. The side jamb of the door may also be finished with the edge trim 20 and trim cleat 20, as shown in FIG. 28. The panel 112 may be cut to length on the job site to form edge 150.

Referring now to FIGS. 29-42, the wall siding system 200 is shown. In the wall siding system 200, the panels 212 are flush with each other as shown in FIG. 33 and not designed to appear to be lapped over one another as shown in the wall siding system 10 shown in FIGS. 1-14. Moreover, the panels 212 are oriented in the vertical direction, as shown in FIG. 29, whereas, the panels 112 shown in the wall siding system 100 are oriented in the horizontal direction as shown in FIG. 15. The wall siding system 200 utilizes the same elongate bottom row 14 and a plurality of short clips 16 that may be utilized to mount the panels 12, 112 to the surface 24. Additionally, the other hardware including but not limited to the top cap 18, the edge trim 20 and the trim cleat 22 may be utilized to cover the opposed distal edges of the panels 212 and interface with wall features such as doors, windows and other surface features (e.g. top edge, side edges, inside corners, outside corners).

In mounting the panels 212 in the vertical direction as shown in FIG. 29, the opposed bottom and top distal end portions 120, 122 of each of the panels have a configuration identical to the bottom and top ends (i.e. oppose side longitudinal edges 116, 118 (see FIG. 15)) as shown in FIG. 33.

The panels 212 may be mounted to the surface 24 from the bottom up direction. The bottom rail 14 may first be attached to the surface 24. By way of example and not limitation, the bottom rail 14 may be attached to the surface with a plurality of wall fasteners 26 as discussed in relation to the wall siding system 10. The bottom rail 14 may have a length that is equal to a width of the surface 24. This means that the length of the bottom rail 14 must extend across the entire width of the surface 24 because the bottom distal end portions 122 of the plurality of vertical panels 212 must rest on the bottom rail 14. The bottom rail 14 provides direct support to all of the panels 212 above it when the wall siding system 200 is mounted to a vertical surface 24. It is contemplated that the bottom rail 14 may be a plurality of short length rails 14 that support one or more vertical panels 212. There may be a sufficient number of bottom rails 14 to support all of the panels 212 mounted to the surface 24. For example, if there are 20 vertical columns of panels 212 mounted to the surface 24 and each rail 14 is sufficiently long to support only one column of panels 212, then there may be 20 rails 14, one rail 14 for each column of panels 212.

The panels 212 are engaged to the rail 14 either from the left to right direction or the right to left direction. However, it is also contemplated that the panels 212 may be engaged to the rail 14 from somewhere in the middle and extend outward to the left and right direction. However, it is preferred to start installation of the panels 212 from the left to right or right to left directions.

A first panel 212 is engaged to the bottom rail 14. The upward extending tongue 40 is engaged to groove 242 of the bottom distal end portion 122 of the vertically oriented panel 212. The clip 16 is attached to the surface 24 with the fastener 26. In securing the clip 16 to the surface 24, the tongue 284 is received into the second groove 70 of the clip 16. The clip 16 may have a length that is less than a width of the panel 212 so that the clip 16 does not engage a panel 212 to its left or right. However, the clip 16 may have a length that is greater than the width of the panel 212. In this case, the clip 16 engages a panel 212 to its left or right. In this case, the ends of the panels 212 are aligned to each other. By way of example and not limitation, as shown in FIG. 29, the end portions 120, 122 in the center of the wall siding system 100 are not aligned to immediately adjacent panels 212. However, the top distal end portions 120 of the uppermost panels 212 are aligned to each other. In this case, the clips 16 (see FIG. 38) may have a length that is greater than a width of the panels 212.

Although the end portions 120, 122 in the center of the wall siding system 100 are not aligned to immediately adjacent panels 212, it is contemplated that the end portions 120, 122 may be aligned to immediately adjacent panels 212. In this case, the clip 16 may have a length that is greater than a width of the panel 212 so that the clip 16 engages to immediately adjacent panels 212.

Figure 34:
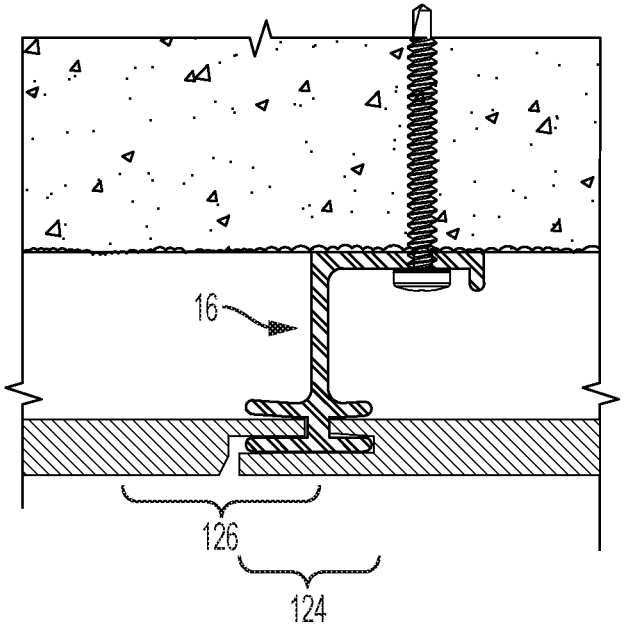
FIG. 34 illustrates another cross-section of the wall siding system shown in FIG. 29.

After installing the first vertical panel 212 to the bottom rail 14 and the corresponding short clip 16 to the top of the first vertical panel 212, an immediately adjacent second panel 212 may be butted up against the first vertical panel 212. The second panel 212 is engaged to the bottom rail 14 and a second short clip 16 is attached to the top distal end portion 120 of the second panel 212. A plurality of additional panels 212 are secured to the surface by engaging the bottom distal end portions 122 of the plurality of additional panels 212 to the rail and engaging the short clips 16 to the top distal end portions 120 of the plurality of additional panels 212. Additionally, as shown in FIG. 34, the left side longitudinal edge 124 may be held and engaged to the right side longitudinal edge 126 with one or more short clips 16 that are oriented 90° with respect to the short clips 16 shown in FIG. 33.

Figure 32:
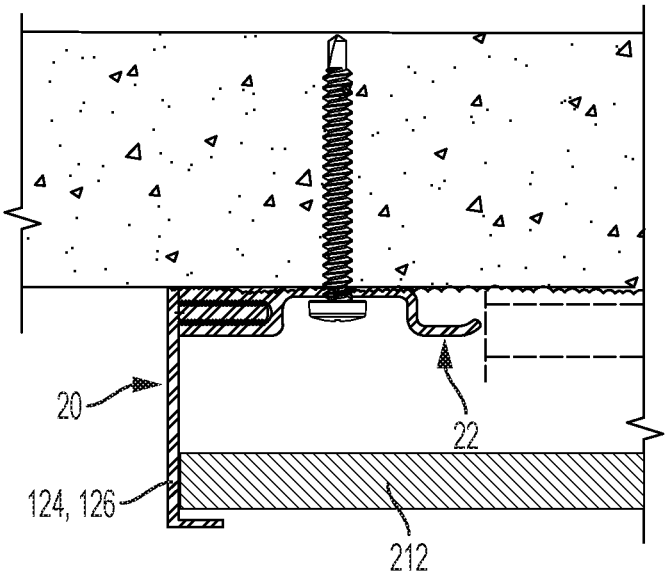
FIG. 32 illustrates another cross-section of the wall siding system shown in FIG. 29.
Figure 35:
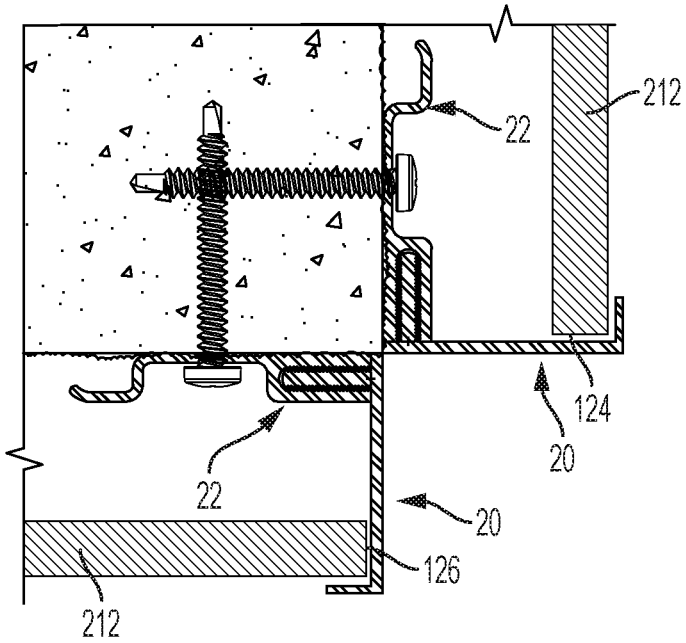
FIG. 35 illustrates another cross-section of the wall siding system shown in FIG. 29.
Figure 36:
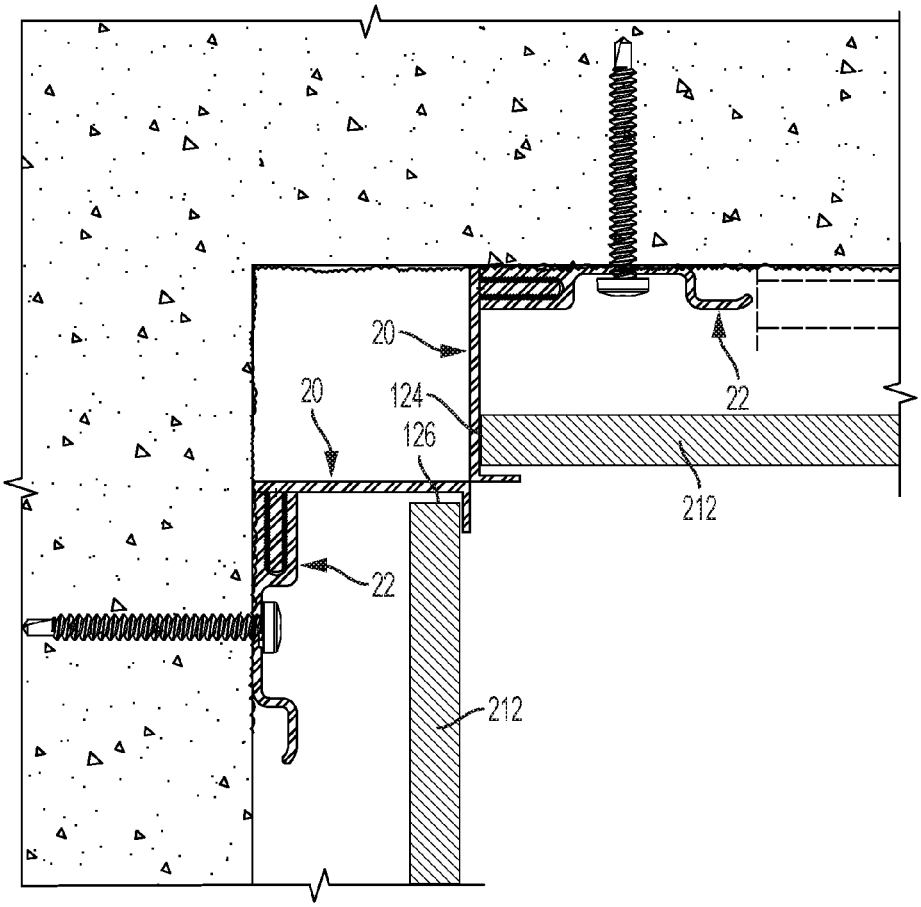
FIG. 36 illustrates another cross-section of the wall siding system shown in FIG. 29.
Figure 44:
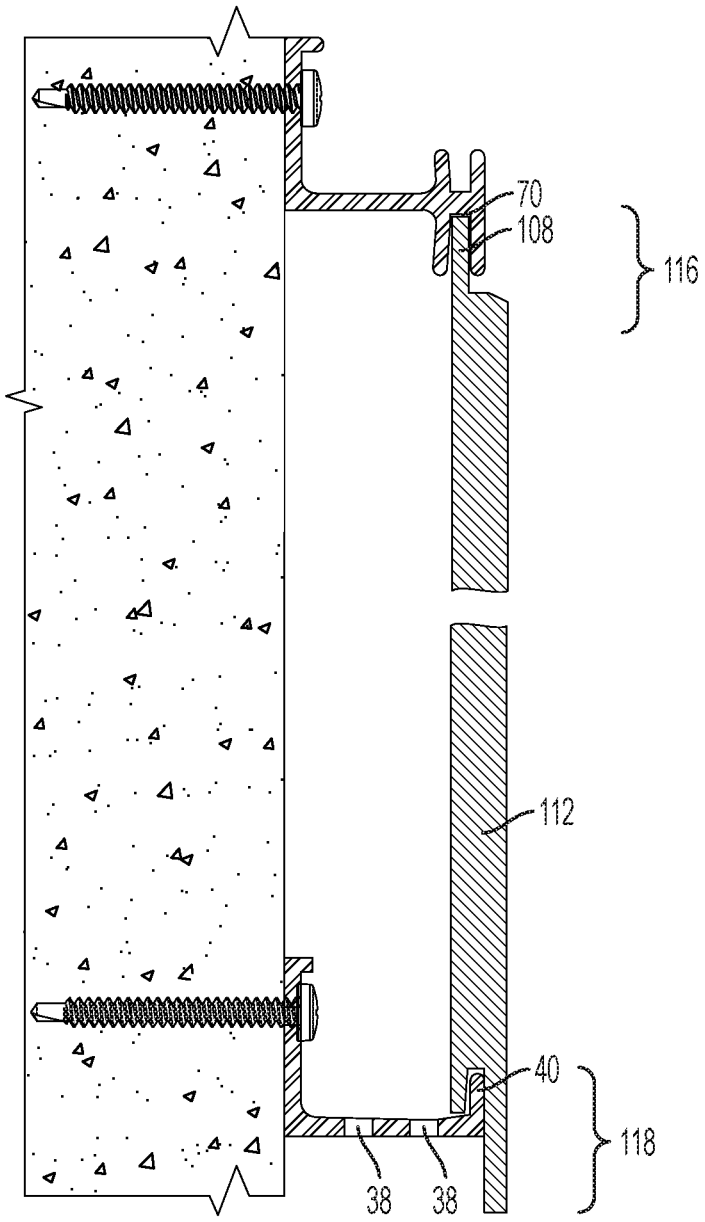
FIG. 44 illustrates a cross-sectional view of the short clip, panel and bottom rail with the panel being vertically oriented so that vertically and horizontally adjacent panels appear to be flush with one another and the panels are oriented in a horizontal orientation.

Referring now to FIG. 32, a side edge of the plurality of wall panels 212 may be finished with edge trim 20 and trim cleat 22. The panel 212 may be cut to length on the job site to form the left or right edges 124, 126 of the panel 212 as needed. As shown in FIG. 35, an outside corner utilizes a pair of trim cleat and edge trims 22, 20 to hide the side longitudinal edges 124, 126 of the panels 212. The panels 212 may be cut to length to form side longitudinal edges 124, 126 on the job site. As shown in FIG. 36, an inside corner utilizes a pair of trim cleat and edge trim 22, 20 to hide the side longitudinal edges 124, 126 of the panels 212. The panels 212 may be cut to length to form side longitudinal edges 124, 126 on the job site Referring now to FIG. 33, the panels 12 appear lapped over one another, whereas, the front surfaces of the panels 112 are coplanar with each other. FIGS. 43 and 44 show the differences in the panels 12, 112 which in particular is directed to the top end portion of the panels 12. The tongue 84 on panel 12 is on the front side, whereas, the tongue 108 on panel 112 is on the backside.

Figure 37:
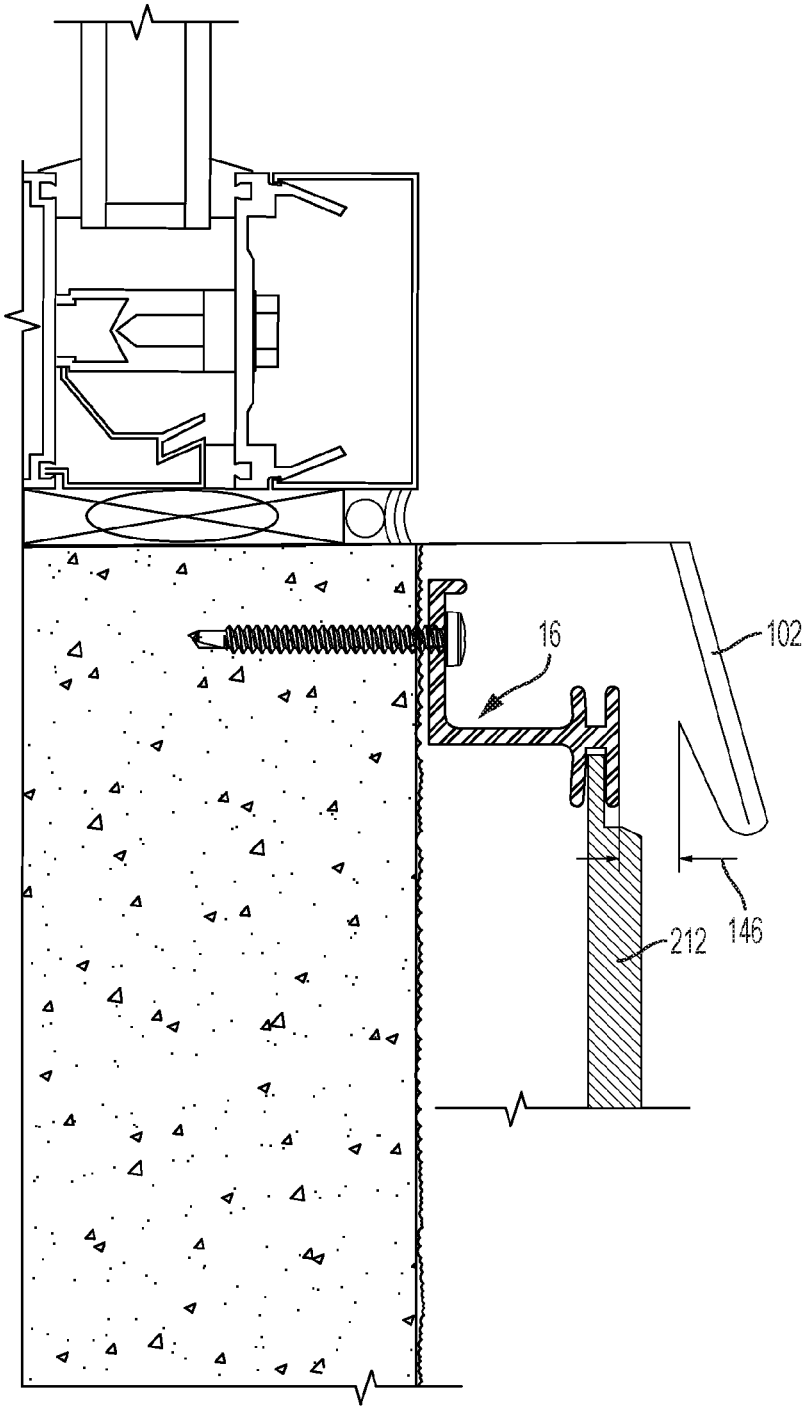
FIG. 37 illustrates another cross-section of the wall siding system shown in FIG. 29.
Figure 38:
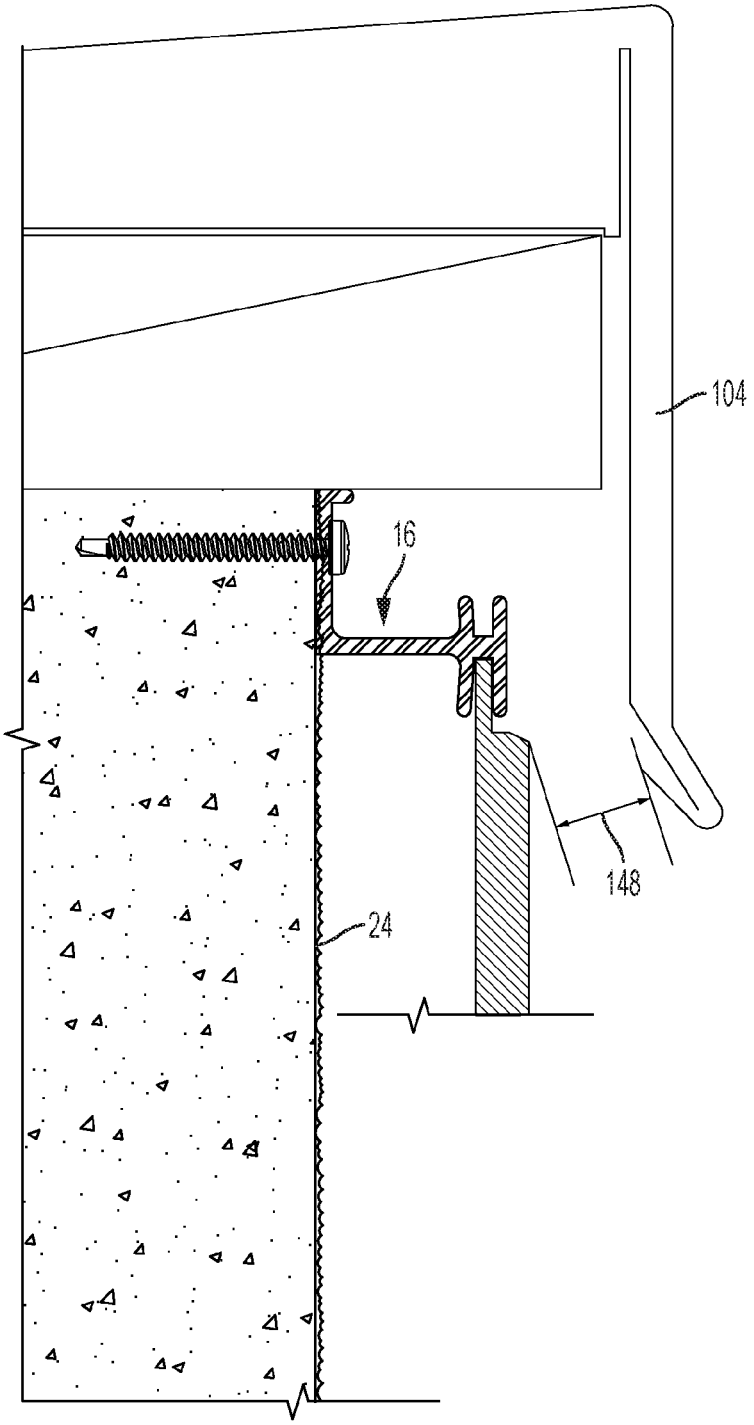
FIG. 38 illustrates another cross-section of the wall siding system shown in FIG. 29.
Figure 39:
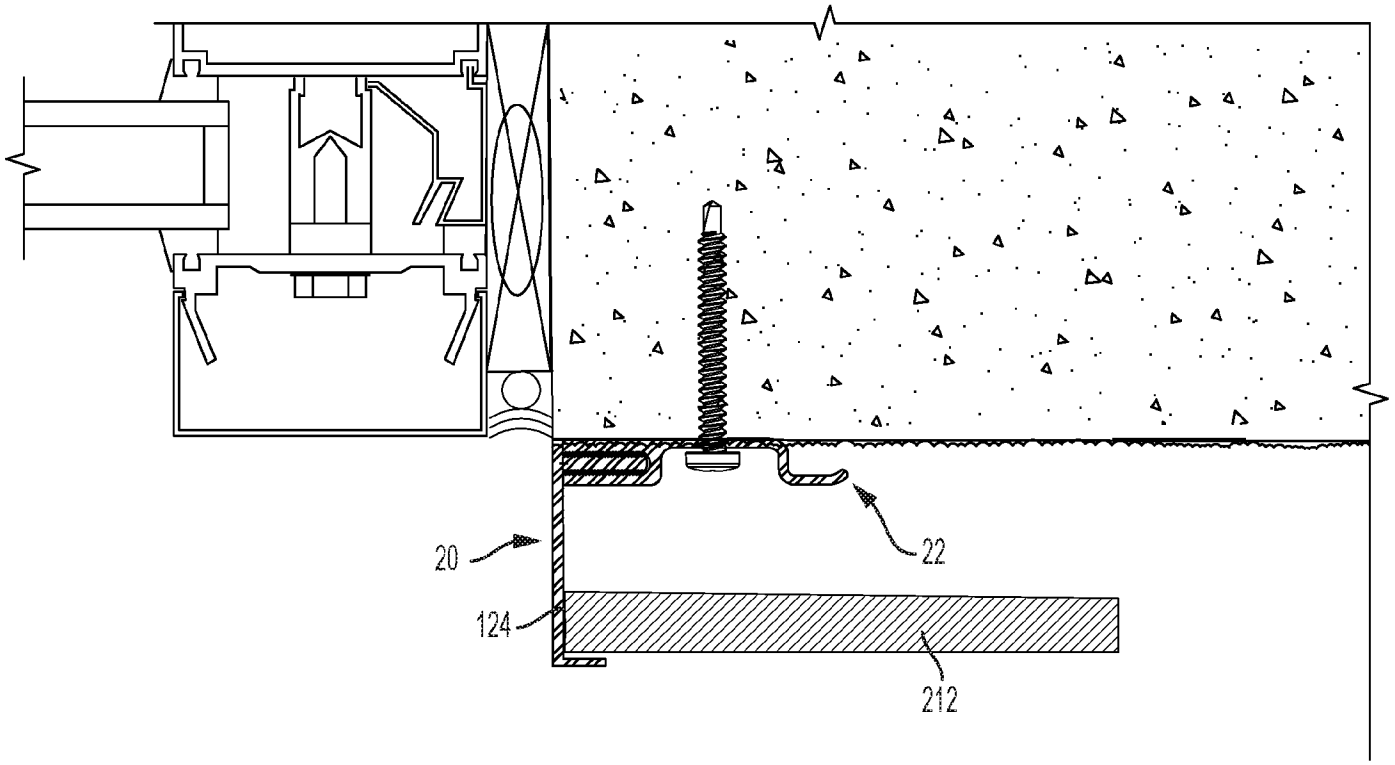
FIG. 39 illustrates another cross-section of the wall siding system shown in FIG. 29.
Figure 40:
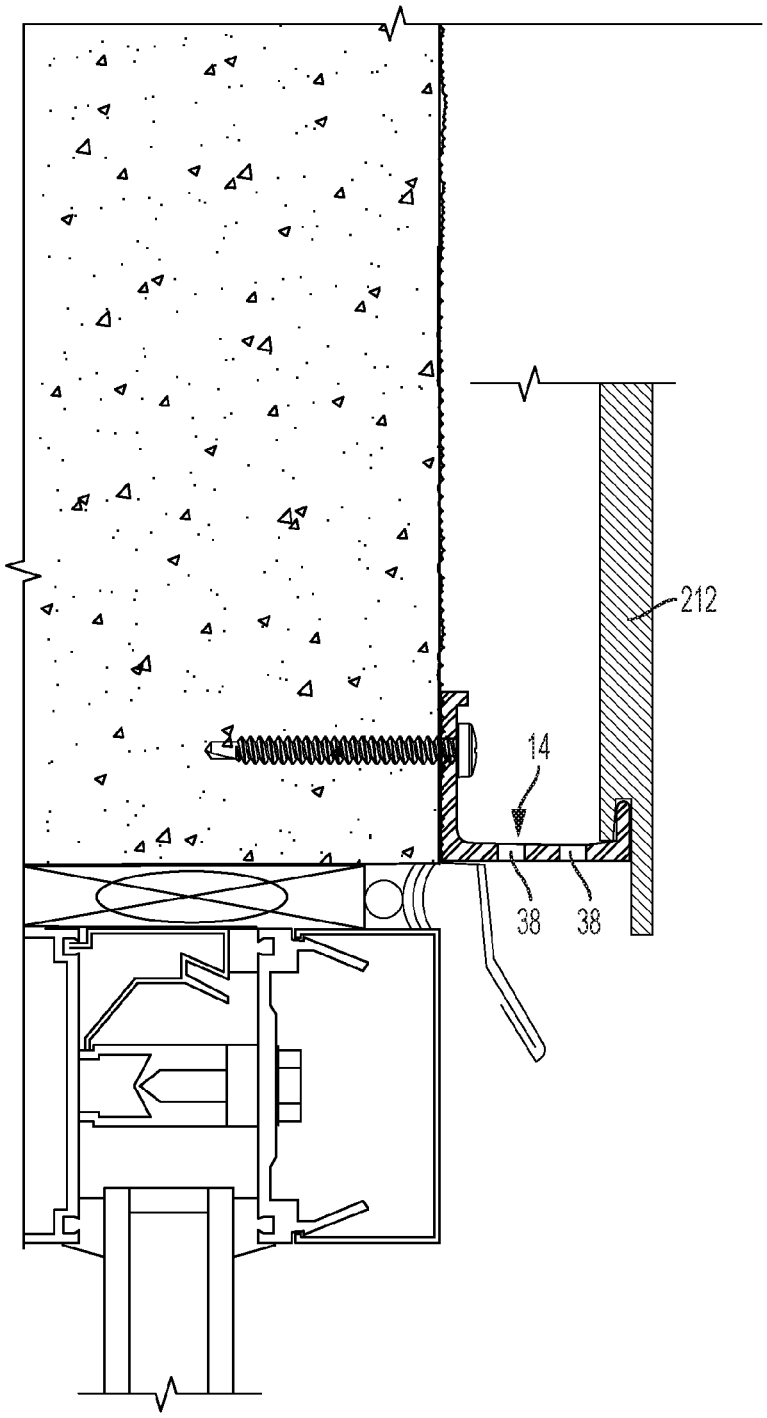
FIG. 40 illustrates another cross-section of the wall siding system shown in FIG. 29.
Figure 41:
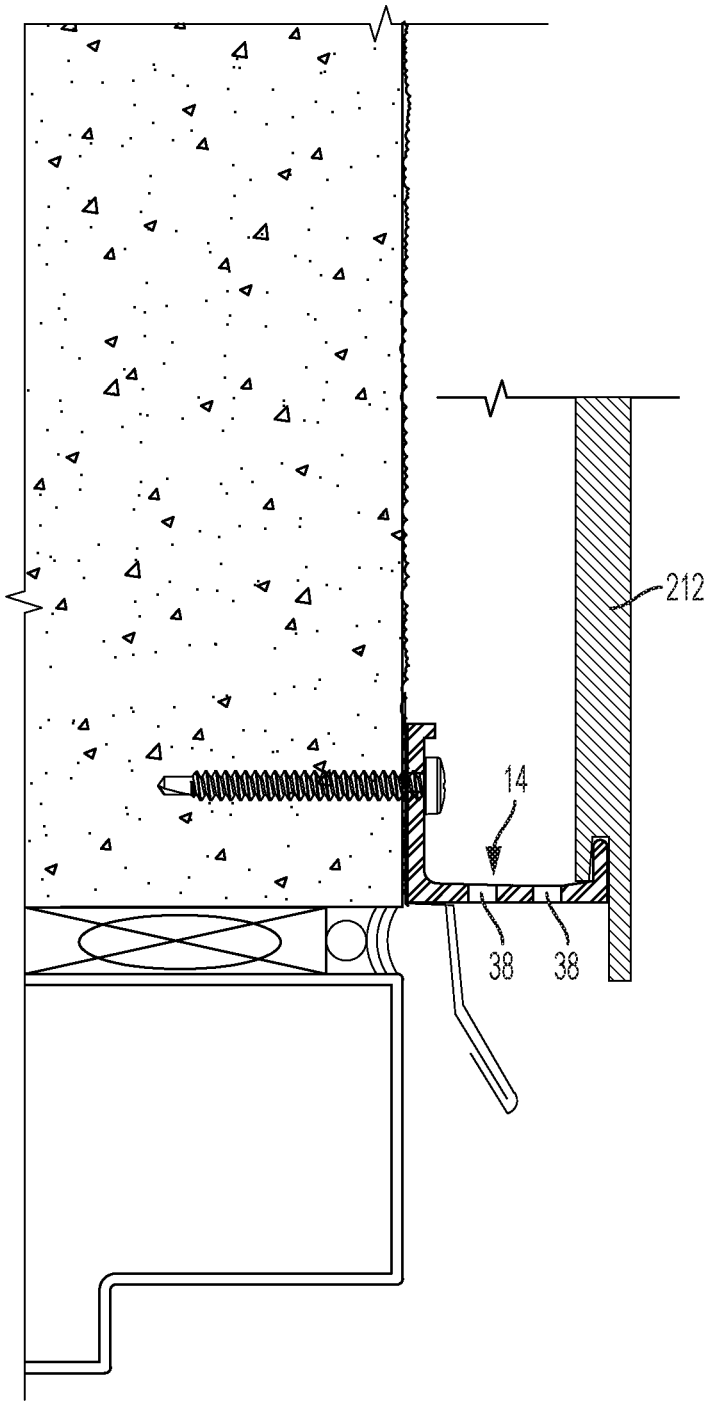
FIG. 41 illustrates another cross-section of the wall siding system shown in FIG. 29.
Figure 42:
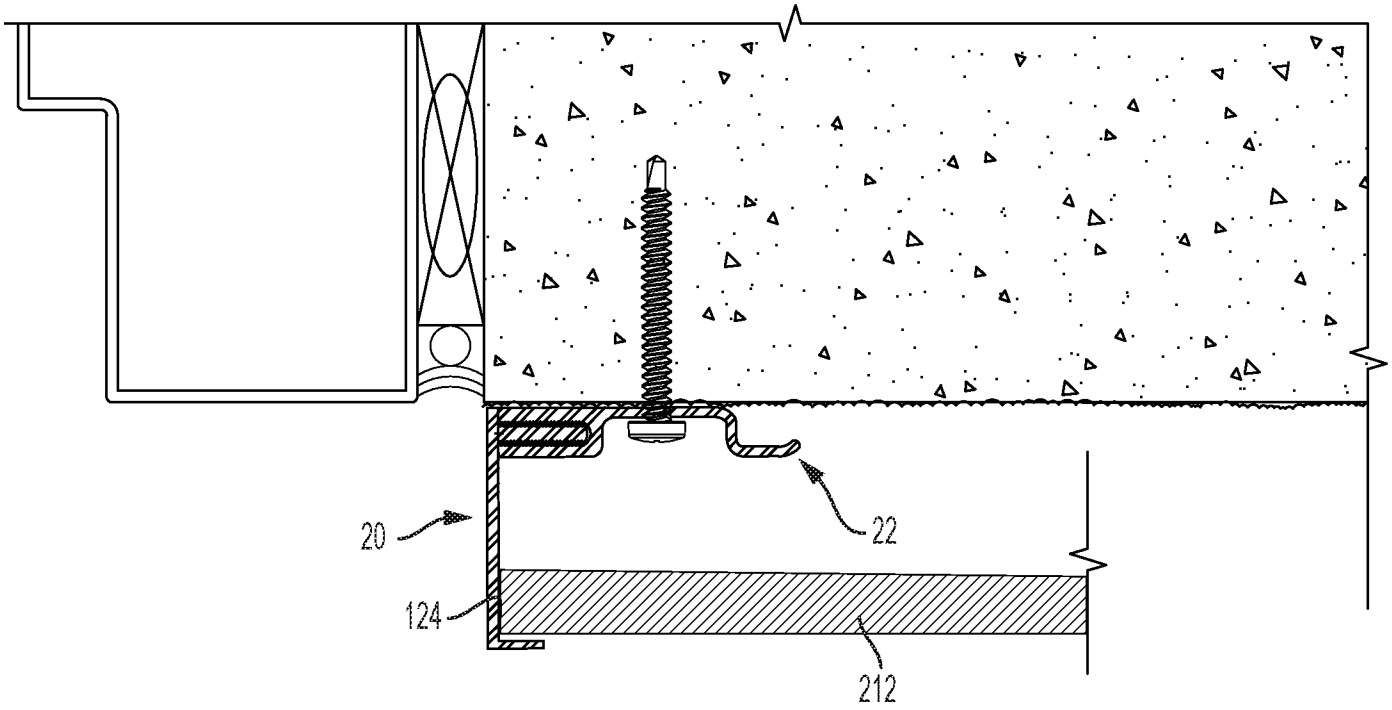
FIG. 42 illustrates another cross-section of the wall siding system shown in FIG. 29.

Referring now to FIG. 37, flashing 102 hides the short clip 16 on a bottom edge of the window. The flashing 102 is spaced away 146 from the clip 16 and since the clips 16 are spaced apart from each other, air is allowed to flow under the flashing 102 and between the clips 16 and behind the panels 212 to dry out any water that might be retained behind the panels 212. Referring now to FIG. 38, flashing 104 hides the short clip 16 on a top edge of the surface 24. The flashing 104 may be spaced away 148 from the clip 16 and since the clips 16 are spaced apart from each other, air is allowed to flow under the flashing 104 and between the clips 16 and behind the panels 212 to dry out any water that might be retained behind panels 212. Referring now to FIG. 39, trim cleat 22 and edge trim 20 hides the edge of the panel 212 adjacent to the window. The panel 212 may be cut to length on the job site in order to form the left side longitudinal edge 124. Referring now to FIG. 40, a bottom rail 14 is utilized to support the panel 212 above the window. Referring now to FIG. 41, bottom rail 14 is utilized to support panels 212 above the door. Referring now to FIG. 42, a trim cleat 22 and edge trim 20 are used to hide the side longitudinal edge 124 of panel 212. The panel 212 may be cut to length on the job site in order to form the left side longitudinal edge 124.

After installing the bottommost vertical panels 212, each column of vertical panels 212 may be completed from the bottom to top of the surface 24 before installing an adjacent column of vertical panels 212. To install a column of vertical panels 212, additional clips 16 are engaged to the top distal end portions 120 of the panels 212. The uppermost panel 212 is cut short so that the top distal end portion 120 is aligned to the top of the surface 24.

Although the bottommost vertical panels 212 are engaged to the bottom rail first, it is also contemplated that each column of vertical panels 212 may be completed before moving onto an adjacent column of vertical panels 212.

Figure 31:
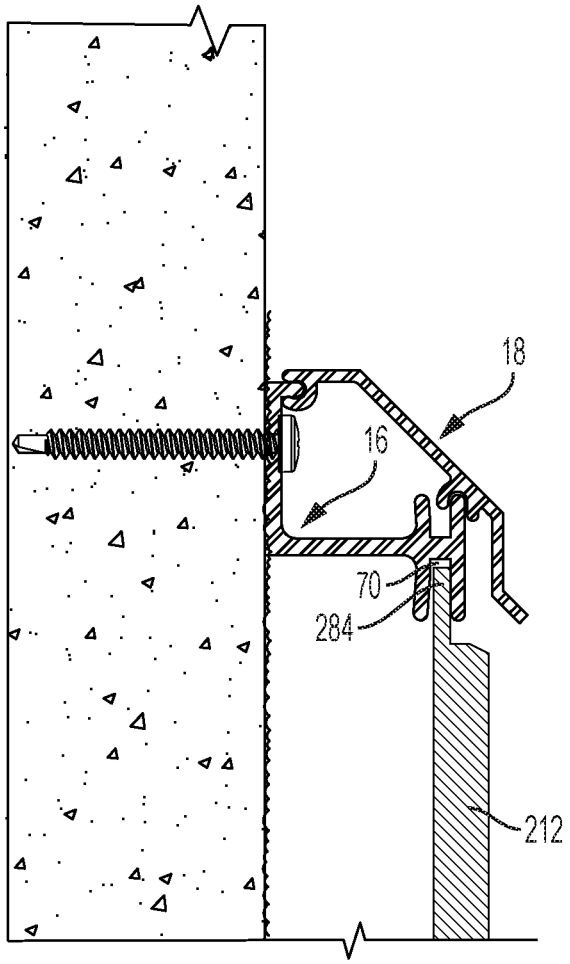
FIG. 31 illustrates another cross-section of the wall siding system shown in FIG. 29.

Referring now to FIG. 31, the top cap 18 may be secured to the short clip 16 when no additional vertical panels 212 are to be stacked upon a lower vertical panel 212. Referring now to FIG. 32, the edge trim 20 and the trim cleat 22 may be utilized to finish a side of the wall siding system 200 so that the side longitudinal edge 124 is not shown. The edge trim 20 hides the side longitudinal edge.

Figure 45:
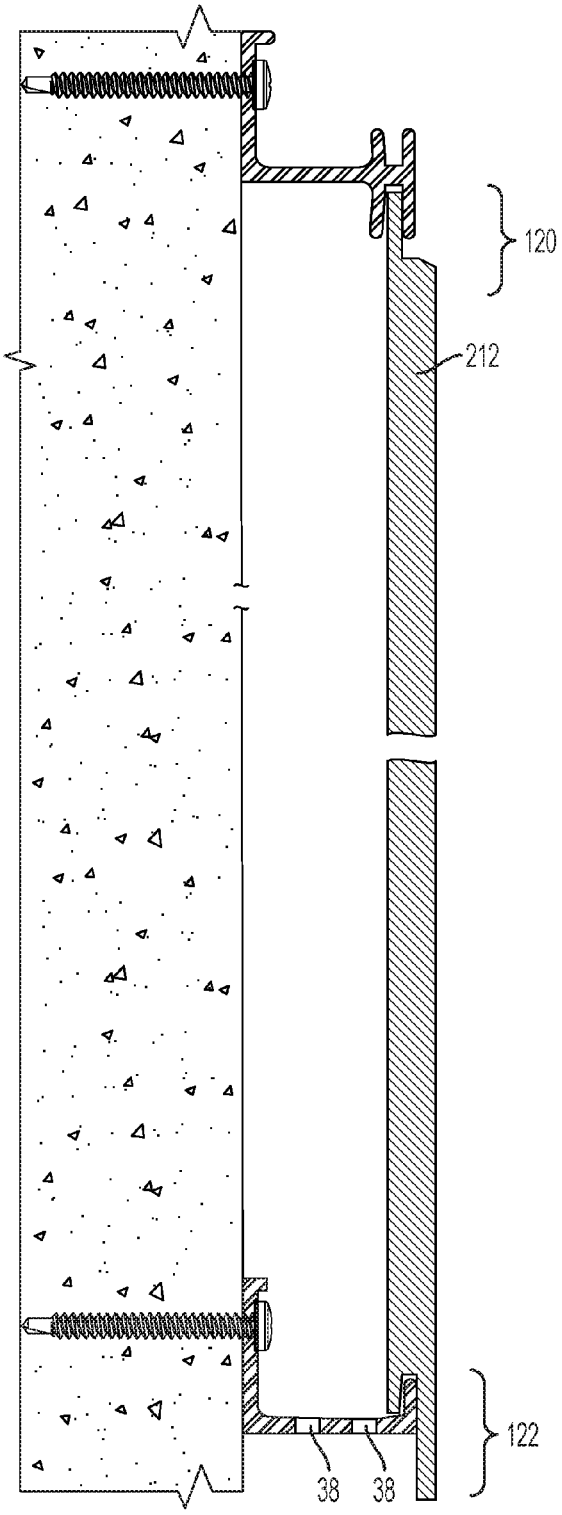
FIG. 45 illustrates a cross-sectional view of the short clip, panel and bottom rail with the panel being vertically oriented so that vertically and horizontally adjacent panels appear to be flush with one another and the panels are oriented in a vertical orientation.

Referring now to FIGS. 43-45, the panel 212 is oriented in the vertical direction and the distal end portions 120, 122 shown in FIG. 45 has the same configuration as the top and bottom side longitudinal edges 116, 118 shown in FIG. 44.

The primary hardware (i.e., bottom rail 14 and the clip 16) and finishing hardware (i.e., top cap, trim cleat and edge trim) discussed herein may be fabricated from an aluminum material. It is also contemplated that the primary and finishing hardware may be fabricated with an extrudable material. By way of example and not limitation, extrudable material includes magnesium, copper, steel, titanium, nickel, refractory alloys, tin, lead, zirconium, molybdenum, beryllium, vanadium, niobium. After extrusion, the primary hardware and finishing hardware may be cut to length as specified herein. Also, any holes for fastening and drainage may be drilled or machined. The panels 12, 112, 212 may be fabricated from phenolic. It is also contemplated that the panels 12, 112, 212 may be fabricated from other materials including but not limited to aluminum, steel, treated wood for outdoor application and wood, plywood for indoor applications.

In the systems 10, 100, 200, the bottom groove 42, 162 (see FIG. 16), 242 (see FIG. 30) of the panel 12, 112, 212 receives the upward extending tongue 40 (see FIGS. 2, 16, 30) and the front wall 82 of the clip 16 (see FIG. 5, 19, 33). However, it is also contemplated instead of a groove 42, 162, 242 formed in the bottom side of the panels 12, 112, 212, a tongue may be formed which is received into a groove of the bottom rail 14 and the clip 16. Moreover, in the systems 10, 100, 200, the tongues 84, 108, 284 of the panel 12 are received into the groove 70 of the clip 16. However, it is also contemplated that the opposite configuration may also be formed. In particular, a tongue may be formed on the clip that is received into a groove formed in the top edge of the panel. Depending on whether the panels are flush mounted or lap mounted, the groove formed in the top edge of the panel may be closer to the front side or the backside of the panel.

The above description is given by way of example, and not limitation. Given the above disclosure, one skilled in the art could devise variations that are within the scope and spirit of the invention disclosed herein, including various ways of trimming the panels on site. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A wall having a flat surface, the wall having a wall siding system mounted on the flat surface for lap mounting first and second panels of the wall siding system, the wall comprising:

each panel of the first and second panels being between 6' to 20' long, 3" to 24" high and having a thickness at least 5/16" wherein each of the first and second panels has a lower groove and an upper tongue, the lower groove defined by a lower lip and a rear tongue, the upper tongue formed closer to a front side of the first and second panels for lap mounting the first and second panels to the flat surface when installed;

a clip less than 12" long attached to the flat surface and positioned between the panels to mount the panels to the flat surface, each of the plurality of clips has upper and lower grooves vertically aligned to each other;

wherein the rear tongue of the second panel is received into the upper groove of the clip, and the upper tongue of the first panel is received into lower groove of the clip to form an appearance of lap mounting the first and second panels to the flat surface.

2. The system of claim 1 further comprising edge trims and trim cleats for hiding edges of the panels.

3. The system of claim 1 further comprising a top cap attachable to the clips for hiding the clips.

4. The system of claim 1 wherein the upper and lower grooves of the clips are defined by upper and lower rear walls and upper and lower front walls, the rear walls being skewed with respect to front walls.

5. The system of claim 4 wherein the upper rear wall of the clip is skewed about 4 degrees from the upper front wall of the clip, and the lower rear wall of the clip is skewed about 4 degrees from the lower front wall of the clip.

6. The system of claim 1 further comprising a bottom rail having a plurality of drainage holes in an extension plate so that water disposed between the flat surface and the panels drain out to mitigate mold formation.

7. The system of claim 6 wherein the panels are parallel with respect to the bottom rail and the clips.

8. The system of claim 6 wherein the panels are perpendicular to the bottom rail and the clips.

9. The system of claim 1 wherein the clips are spaced apart from each other to facilitate movement of air between the surface and the panels.

10. A method of installing a wall siding system, the method comprising the steps of:

attaching a bottom rail to a flat surface, the bottom rail being level to a ground;

engaging a bottom edge of a first panel to the bottom rail with a tongue and groove connection;

attaching a first row of clips to the flat surface, the clips of the first row being spaced apart from each other to permit air to flow between the spaced apart clips of the first row and the flat surface and the first panel;

engaging an upper tongue of the first panel to a lower groove of the clips of the first row, a first configuration of the upper tongue of the first panel being disposed closer to a front side of the first panel for lap mounting of the first panel with respect to a second panel, a second configuration of the upper tongue of the first panel being disposed closer to a back side of the first panel for flush mounting the first panel with respect to the second panel, the lower groove being sized and configured to receive either one of the first and second configurations of the upper tongue so that the same clips of the first row can be used to lap or flush mount the first and second panels;

engaging a bottom edge of the second panel to the clips of the first row with a tongue and groove connection;

engaging a second row of clips to the flat surface, the clips of the second row being spaced apart from each other to permit air to flow between the spaced apart clips of the second row and the flat surface and the second panel;

engaging an upper tongue of the second panel to a lower groove of the clips of the second row, the upper tongue of the second panel having either the first or second configuration, the lower groove of the second row of clips being sized and configured to receive either one of the first and second configurations of the upper tongue so that the same clips of the second row can be used to lap or flush mount the first and second panel.

11. The method of claim 10 further comprising the step of providing the clips with upper and lower grooves, the upper and lower grooves defined by upper and lower front and rear walls, the rear walls being skewed from the front walls so that the panels can tilt for lap mounting of the panels or be vertical for flush mounting of the panels.

12. The method of claim 11 wherein the providing step further comprises the step of providing the skew angle between the front and rear walls of about 4 degrees.

13. A wall having a flat surface, the wall having a wall siding system mounted on the flat surface for lap mounting first and second panels of the wall siding system, the wall comprising:

each panel of the first and second panels being between 6' to 20' long, 3" to 24" high and having a thickness at least 5/16" wherein each of the first and second panels has a lower groove and an upper tongue, the lower groove defined by a lower lip and a rear tongue, a first configuration of the upper tongue formed closer to a front side of the first and second panels for lap mounting the first and second panels to the flat surface when installed and a second configuration of the upper tongue forming closer to a rear side of the first and second panels for flush mounting the first and second panels to the flat surface when installed;

a plurality of clips less than 12" long attached between the first and second panels to mount the first and second panels to the flat surface, each of the plurality of clips has upper and lower grooves vertically aligned to each other, the upper and lower grooves of the clips are defined by upper and lower rear walls and upper and lower front walls, the rear wall of the lower groove being skewed with respect to the respective front wall so that the lower groove universally receives either one of the first and second configurations of the upper tongue of the first and second panels, the first and second panels being lap mounted when the upper tongue is closer to the front side of the first and second panels, and the first and second panels being flush mounted when the upper tongue is formed closer to the rear side of the first and second panels;

wherein the rear tongue of the second panel is received into the upper grooves of the plurality of clips, and the upper tongue of the first panel is received into lower groove of the plurality of clips to form an appearance of lap mounting or flush mounting the first and second panels to the flat surface depending whether the upper tongue has the first or second configurations.

* * * * *